US011499312B2

(12) United States Patent
Moore et al.

(10) Patent No.: US 11,499,312 B2
(45) Date of Patent: Nov. 15, 2022

(54) COLLAPSIBLE ACOUSTIC HONEYCOMB CEILING INSTALLATION

(71) Applicant: 3FORM, LLC, Salt Lake City, UT (US)

(72) Inventors: Charles H. Moore, Salt Lake City, UT (US); Matthew T. Sutton, Salt Lake City, UT (US); Danielle P. Hadley, Ogden, UT (US); Guillaume Martin, Rochetoirin (FR); Michael Damen, Rochetoirin (FR)

(73) Assignee: 3FORM, LLC, Salt Lake City, UT (US)

( * ) Notice: Subject to any disclaimer, the term of this patent is extended or adjusted under 35 U.S.C. 154(b) by 963 days.

(21) Appl. No.: 16/155,679

(22) Filed: Oct. 9, 2018

(65) Prior Publication Data

US 2019/0106883 A1 Apr. 11, 2019

Related U.S. Application Data

(63) Continuation of application No. 62/570,574, filed on Oct. 10, 2017.

(51) Int. Cl.

| | |
|---|---|
| ***E04B 9/04*** | (2006.01) |
| ***E04B 1/84*** | (2006.01) |
| ***E04B 9/22*** | (2006.01) |
| ***E04B 9/34*** | (2006.01) |
| ***E04B 9/24*** | (2006.01) |
| ***E04B 9/36*** | (2006.01) |

(Continued)

(52) U.S. Cl.

CPC ..... *E04B 9/0464* (2013.01); *E04B 1/84* (2013.01); *E04B 9/225* (2013.01); *E04B 9/24* (2013.01); *E04B 9/345* (2013.01); *E04B 9/366* (2013.01); *E04B 9/001* (2013.01); *E04B 9/008* (2013.01); *E04B 9/0407* (2013.01); *E04B 9/18* (2013.01); *E04B 2001/748* (2013.01); *E04B 2001/8414* (2013.01)

(58) Field of Classification Search

CPC ..... E04B 9/0464; E04B 1/84; E04B 9/225; E04B 9/24; E04B 9/345; E04B 9/366; E04B 9/001; E04B 9/008; E04B 9/0407; E04B 9/18; E04B 2001/748; E04B 2001/8414

See application file for complete search history.

(56) References Cited

U.S. PATENT DOCUMENTS 4,452,025 A * 6/1984 Lew ..... E04C 2/422 52/668
4,785,604 A * 11/1988 Johnson, Jr. ..... E01C 11/16 405/15

(Continued)

*Primary Examiner* — Patrick J Maestri
(74) *Attorney, Agent, or Firm* — Workman Nydegger

(57) ABSTRACT

A collapsible acoustic honeycomb ceiling installation can be made by cutting desired material into panels. Next, a manufacturer can cut one or more notches into the panels. The manufacturer can assemble the collapsible acoustic honeycomb ceiling installation by aligning the one or more notches on the panels and slideably connecting the panels. The resultant collapsible acoustic honeycomb ceiling installation can provide a versatile decorative feature to a space while maintaining or altering the acoustics of the space as desired. Further, because the ceiling installation is collapsible, a manufacturer or installer can easily transport, install, and remove the ceiling installation.

18 Claims, 18 Drawing Sheets

(51) Int. Cl.

| | |
|---|---|
| *E04B 1/74* | (2006.01) |
| *E04B 9/00* | (2006.01) |
| *E04B 9/18* | (2006.01) |

(56) References Cited

U.S. PATENT DOCUMENTS

| | | | | |
|---|---|---|---|---|
| 5,797,236 | A * | 8/1998 | Posey, Jr. | B65D 5/48038 52/799.12 |
| 7,591,611 | B2 * | 9/2009 | Arellanes | E02B 3/108 405/116 |
| 8,458,980 | B2 * | 6/2013 | Ivanov | A63H 33/084 446/105 |
| 2002/0078653 | A1 * | 6/2002 | Jean | E04B 9/345 446/124 |
| 2004/0163888 | A1 * | 8/2004 | Johnson | F02K 1/827 181/294 |

* cited by examiner

COLLAPSIBLE ACOUSTIC HONEYCOMB CEILING INSTALLATION

CROSS-REFERENCE TO RELATED APPLICATIONS

This application claims priority to U.S. Provisional Application 62/570,574 entitled COLLAPSIBLE ACOUSTIC HONEYCOMB CEILING ELEMENT, filed on Oct. 10, 2017, the entirety of which is incorporated herein by reference.

BACKGROUND OF THE INVENTION

1. The Field of the Invention

This invention relates to systems, apparatus, and methods for preparing collapsible ceiling installations.

2. Background and Relevant Art

When designing and decorating home and business spaces, ceilings are often an overlooked surface. However, ceiling installations can richly enhance the aesthetic appearance of spaces, as well as offer acoustic advantages. There are many different types of ceilings used in residential, commercial, and industrial settings. These ceilings may include a variety of features such as dropped ceilings having tiles and grid frame elements, flat surfaces, drywall portions, exposed elements such as beams and trusses, and other structural or aesthetic elements. Each type of ceiling affects the lighting, acoustics, and physical space available within a room. As such, builders and occupants often want to alter or customize a ceiling to their needs or wants.

For example, large spaces, including factories, convention centers, or other industrial spaces, often do not include finished dropped ceilings. Instead, these spaces tend to include ceilings with exposed beams, exposed ventilation elements such as ducts and vents, and other exposed architectural components. Generally, providing full dropped ceiling elements in such large spaces is cost prohibitive. However, occupants or builders may want to dampen acoustic reflections that cause echoes in large spaces. Occupants and builders may also desire more aesthetically pleasing elements in certain areas of the large space, such as for office spaces within a factory.

In contrast, traditional office spaces often include finished dropped ceilings, including ceiling tiles assembled within a grid frame. These tile ceilings may not be aesthetically or acoustically pleasing. Also, depending on the materials used, the flat surface tiles may undesirably reflect or dampen the acoustics within a room. As such, builders or occupants of such rooms often desire to alter the ceiling by installing customized ceiling elements.

For example, builders or occupants of such spaces may want to alter an existing ceiling with other elements that disperse light in a more aesthetically pleasing way without affecting the acoustics of the space. Also, builders or occupants may want to install ceiling elements that absorb sound to reduce echoes within a room. Conversely, some occupants and builders may want to install ceiling elements that absorb sound to a lesser degree and direct sound in certain ways.

The same principles apply to residential spaces, where residents often find existing ceilings undesirable for a number of reasons. For example, some ceilings can cause a room to appear darker because the ceiling elements absorb light, while other types of ceilings may cause undesirable acoustics, as noted above. In any case, builders and occupants typically do not alter ceilings very often due to the difficulty and expense of ceiling installation and alteration. They may want to do so as the use of a room changes from one occupant to the next, or as new aesthetic styles emerge.

Currently, ceiling installations tend to be bulky, inflexible and difficult to install. This is especially true considering the different ceiling types mentioned above, which may each require different installation structures or elements. For example, dropped tile ceiling installations may be compatible with flat exposed ceilings, but may be more difficult to install with a vaulted ceiling having exposed trusses and beams or a low, flat ceiling having drywall portions.

In addition, builders and residents may want to alter only a portion of a ceiling within a room, rather than reconstruct the entire ceiling, for aesthetic or acoustic reasons. Again, this is often difficult due to the variety of ceilings and structural elements designed specifically for those ceilings. For example, dropped ceilings often include a grid frame with tiles placed on the grid frame. The grid frame usually extends across the entire ceiling space so that the tiles cover the whole room. Thus, if a builder or resident wants to alter only a portion of the ceiling, it may be difficult to incorporate new or custom ceiling elements with the existing grid frame. Additionally, it may be difficult to remove only portions of the grid frame to accommodate the new ceiling installation elements without negatively effecting the rest of the ceiling or grid frame.

Furthermore, shipping and handling of ceiling installation elements presents additional difficulties for builders and occupants. Often, ceiling installation elements are bulky and inflexible. Manufacturers generally form ceiling elements and ship them as single large pieces that do not collapse, bend, or otherwise reduce in volume. This results in expensive shipping and handling of ceiling installation elements for builders and occupants who want to alter a ceiling.

For example, builders may utilize large ceiling panels that hang from an exposed ceiling. A manufacturer forms these panels as a single piece and ships the panels to the builder. The large size of the panels results in high shipping costs. Likewise, in other ceiling installations, such as those that employ ceilings tiles, manufacturers form the tiles into shapes that cannot be altered, disassembled, or otherwise reduced in volume to save shipping costs.

Accordingly, builders and occupants generally cannot reshape, reconfigure, or rearrange existing ceiling installation elements. Thus, it is difficult to utilize existing ceiling installation elements to periodically change and customize a ceiling as desired.

Accordingly, there are a number of problems in the art that can be addressed with respect to ceiling design and installations.

BRIEF SUMMARY OF THE INVENTION

Implementations of the present invention solve one or more problems in the art with systems and methods configured to create an acoustic, collapsible ceiling installation. In particular, implementations of the present disclosure allow a manufacturer to form and assemble a collapsible ceiling installation using composite material, textile, or thermoplastic. The manufacturer may assemble the collapsible ceiling installation by interlocking panels to form a collapsible design. The resultant assembled ceiling installation may form at least a portion of a ceiling or be incorporated into an existing ceiling by dropping the installation into a ceiling grid frame, as a cloud installation, or by floating cables.

For example, in one implementation of the present disclosure, a collapsible acoustic honeycomb installation includes a plurality of panels. Each of the plurality of panels has a length of at least 16-inches, a height of at least 1-inch, and a thickness equal to or greater than ⅛-inch. In addition, each panel may have a plurality of assembly notches and a plurality of installment notches. The assembly notches have widths that are equal to or greater than the thickness of each panel. In such an implementation, each panel is slideably connectable to at least one other panel through respective assembly notches to form the collapsible ceiling installation.

Also, in such an implementation, the slideably connectable panels can rotate relative to one another about each assembly notch where two or more panels are connected. As such, the collapsible ceiling installation is reversibly collapsible due to the rotation of each panel relative to other panels. In addition, each installment notch is disposed at an outer edge of the collapsible ceiling installation.

In another implementation of the present disclosure, a method of manufacturing a collapsible acoustic honeycomb ceiling installation includes cutting desired material into a plurality of panels. Each panel has a length of at least 16-inches, a height of at least 1-inch, and a thickness equal to or less than ⅛-inch. Next, the method includes the step of cutting a plurality of assembly notches into at least one longitudinal edge of each of the plurality of panels. The method further comprises cutting at least one installment notch into at least one transverse edge of the each of the plurality of panels. Next, the method includes aligning one of the plurality of assembly notches on at least one of the plurality of panels with an assembly notch of at least one other panel.

In such an implementation, each of the installment notches are disposed at an outer edge of the collapsible ceiling installation. Also, each of the plurality of panels are rotatable relative to at least one other connected panel at respective aligned assembly notches so that the collapsible ceiling installation is reversibly collapsible.

In yet another implementation of the present disclosure, a method of installing a collapsible acoustic honeycomb ceiling installation includes securing the collapsible acoustic honeycomb installation within a room to form at least a portion of a ceiling. In such an implementation, the collapsible acoustic honeycomb installation comprises a plurality of panels. Each of the plurality of panels has a length of at least 16-inches, a height of at least 1-inch, and a thickness equal to or greater than ⅛-inch. In addition, each panel may have a plurality of assembly notches and a plurality of installment notches. The assembly notches have widths that are equal to or greater than the thickness of each panel. In such an implementation, each panel is slideably connectable to at least one other panel through respective assembly notches to form the collapsible ceiling installation.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
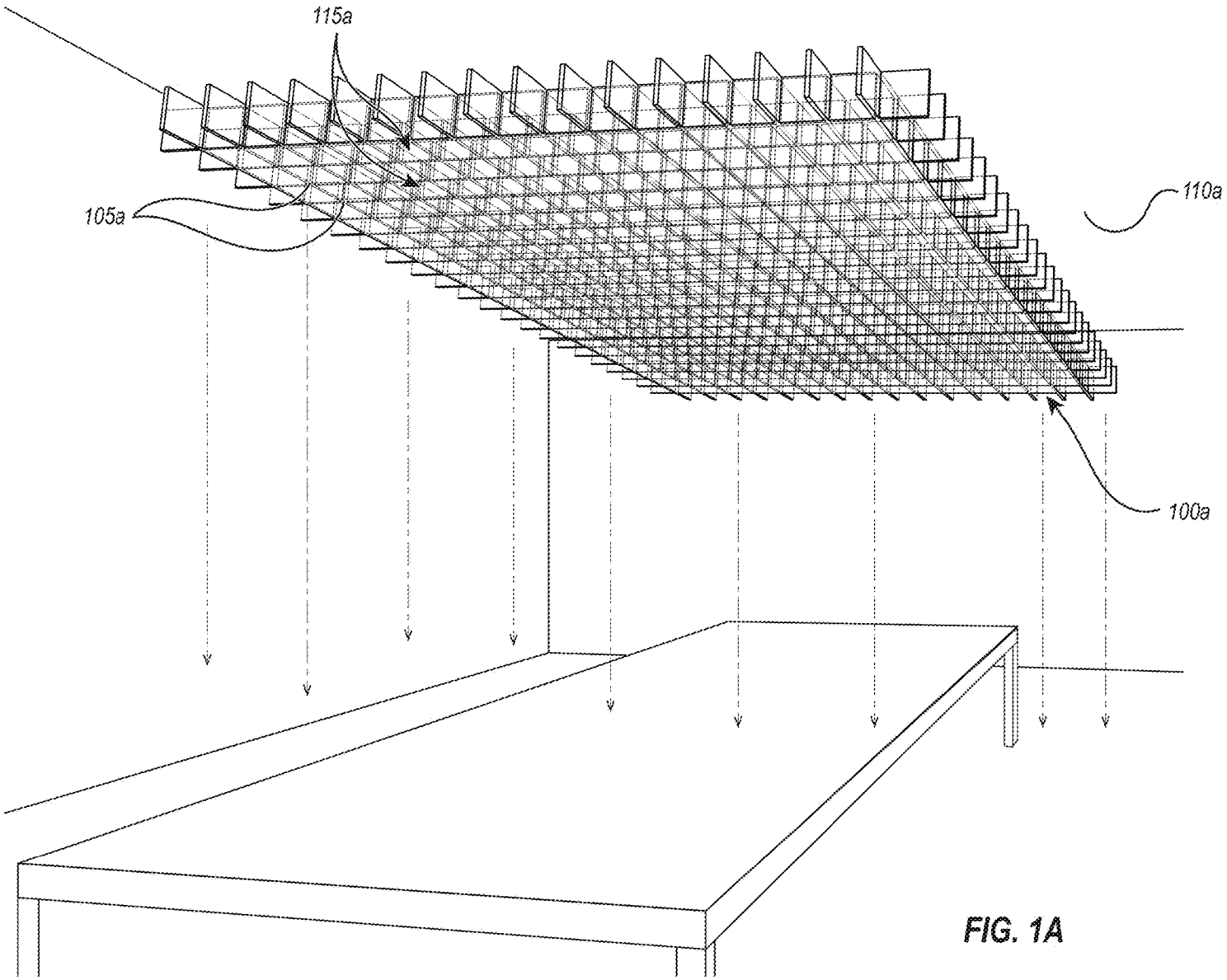
FIG. 1A illustrates an exemplary collapsible acoustic honeycomb ceiling installation in accordance with an implementation of the present invention.

The present invention extends to systems, apparatus, and methods configured to create an acoustic, collapsible ceiling installation. In particular, implementations of the present invention allow a manufacturer to form and assemble a collapsible ceiling installation using composite material, textile, or thermoplastic. The manufacturer may assemble the collapsible ceiling installation by interlocking panels to form a collapsible design. The resultant assembled ceiling installation may be installed by dropping the installation into the ceiling grid, as a cloud installation, or by floating cables.

For example, in one implementation of the present disclosure, a collapsible acoustic honeycomb installation includes a plurality of panels. Each of the plurality of panels has a length of at least 16-inches, a height of at least 1-inch, and a thickness equal to or greater than ⅛-inch. In addition, each panel may have a plurality of assembly notches and a plurality of installment notches. The assembly notches have widths that are equal to or greater than the thickness of each panel. In such an implementation, each panel is slideably connectable to at least one other panel through respective assembly notches to form the collapsible ceiling installation.

Also, in such an implementation, the slideably connectable panels can rotate relative to one another about each assembly notch where two or more panels are connected. As such, the collapsible ceiling installation is reversibly collapsible due to the rotation of each panel relative to other panels. In addition, each installment notch is disposed at an outer edge of the collapsible ceiling installation.

In another implementation of the present disclosure, a method of manufacturing a collapsible acoustic honeycomb ceiling installation includes cutting desired material into a plurality of panels. Each panel has a length of at least 16-inches, a height of at least 1-inch, and a thickness equal to or less than ⅛-inch. Next, the method includes the step of cutting a plurality of assembly notches into at least one longitudinal edge of each of the plurality of panels. The method further comprises cutting at least one installment notch into at least one transverse edge of the each of the plurality of panels. Next, the method includes aligning one of the plurality of assembly notches on at least one of the plurality of panels with an assembly notch of at least one other panel.

In such an implementation, each of the installment notches are disposed at an outer edge of the collapsible ceiling installation. Also, each of the plurality of panels are rotatable relative to at least one other connected panel at respective aligned assembly notches so that the collapsible ceiling installation is reversibly collapsible.

In yet another implementation of the present disclosure, a method of installing a collapsible acoustic honeycomb ceiling installation includes securing the collapsible acoustic honeycomb installation within a room to form at least a portion of a ceiling. In such an implementation, the collapsible acoustic honeycomb installation comprises a plurality of panels. Each of the plurality of panels has a length of at least 16-inches, a height of at least 1-inch, and a thickness equal to or greater than ⅛-inch. In addition, each panel may have a plurality of assembly notches and a plurality of installment notches. The assembly notches have widths that are equal to or greater than the thickness of each panel. In such an implementation, each panel is slideably connectable to at least one other panel through respective assembly notches to form the collapsible ceiling installation.

Because the ceiling installation is collapsible, it may be easily and cheaply shipped, transported, installed, and removed. For example, a manufacturer can ship the panels in collapsed form to reduce volume and cost. The installer can then expand the panels upon installation. The ceiling installation is also versatile and allows the user to adjust, reconfigure, and/or alter the panels that comprise the ceiling installations.

Additionally, or alternatively, the manufacturer can ship each ceiling installation as unassembled panels to save cost, and the installer can assemble the panels as desired upon installation. In this way, the installer can customize each ceiling installation by rearranging how the panels of a ceiling installation are assembled together.

In addition, an installer can install implementations of ceiling installations described herein easily and quickly with a wide variety of ceiling types and spaces. Thus, an installer can periodically rearrange and/or reconfigure a ceiling, regardless of the type of ceiling, with little effort or cost. The collapsibility and reconfigurability of ceiling installations described in the present disclosure are especially advantageous given the large scale of components and parts typically associated with ceilings and ceiling installations.

The installed ceiling installation provides a decorative feature to a space without interfering with the space's acoustics. In one or more implementations, an installer can install the ceiling installation to customize acoustic effects within the room. For example, in one implementation, an installer can place one or more ceiling installations of various configurations at various positions within the ceiling. The installer can do so to increase, decrease, or maintain acoustic reflection, absorption, or otherwise affect the acoustic properties of a room as desired.

Also, in one or more implementations of the present disclosure, an installer can customize the aesthetic appearance of a room. For example, in one or more implementations, the installer can customize individual ceiling installations of various shapes and optical properties. The installer can also install each ceiling installation within a ceiling in any desired position or configuration. Accordingly, the installer can configure a ceiling to include ceiling installations that reflect and disperse light in an aesthetically pleasing way.

Figure 1B:
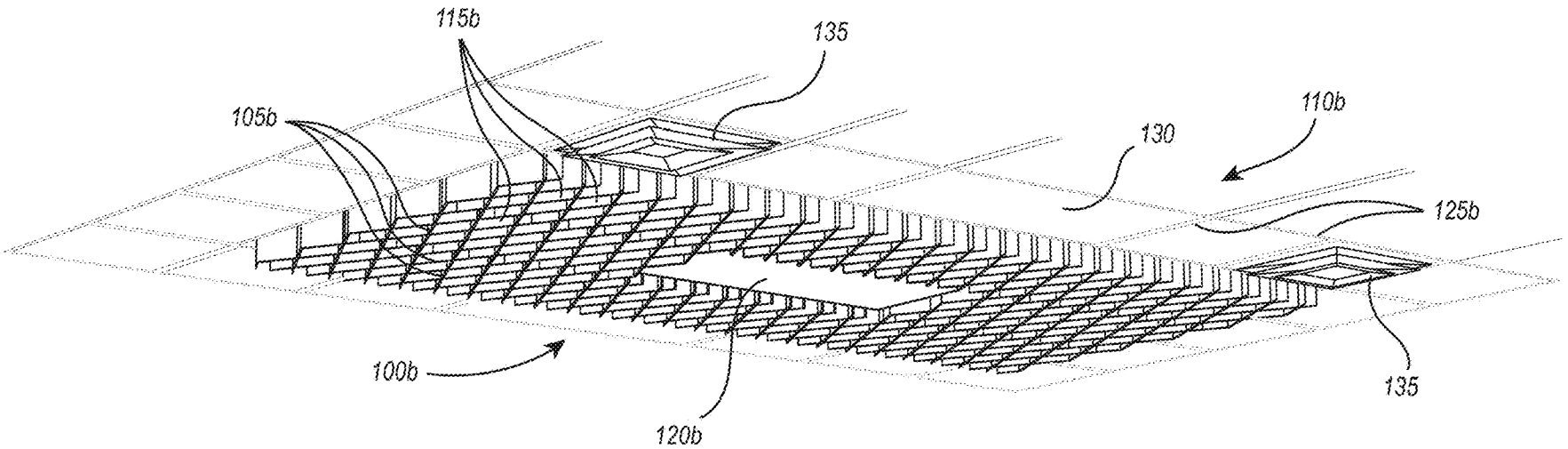
FIG. 1B illustrates an exemplary collapsible acoustic honeycomb ceiling installation in accordance with an implementation of the present invention.
Figure 1C:
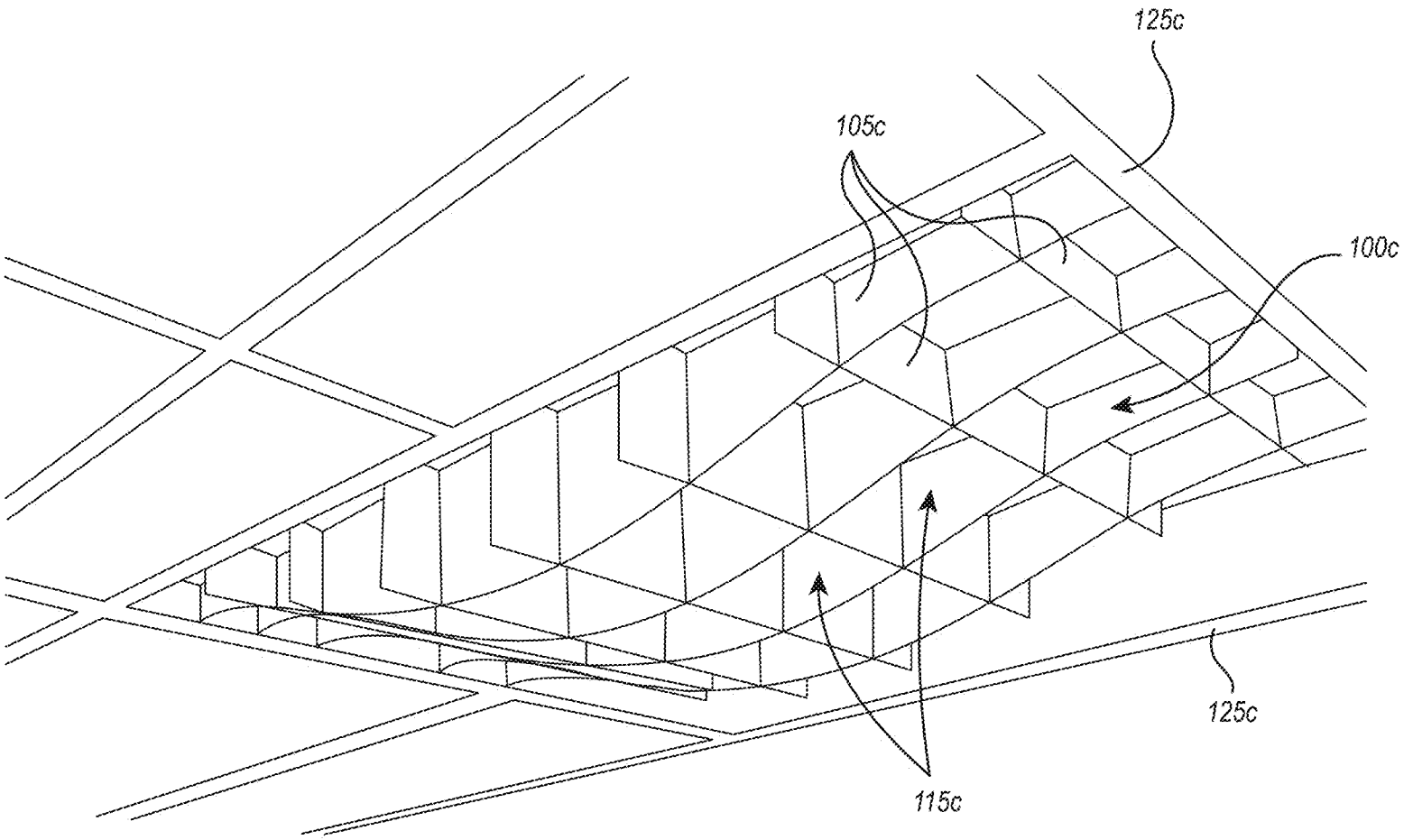
FIG. 1C illustrates an exemplary collapsible acoustic honeycomb ceiling installation in accordance with an implementation of the present invention.

FIGS. 1A-1C show exemplary collapsible acoustic honeycomb ceiling installations 100*a-c*. More specifically, FIG. 1A illustrates an installation 100*a* made of composite panels 105*a* of laminated thermoplastic and textile. An installer or manufacturer can assemble the panels 105*a* together to form customized installations 100*a*. In this illustrated implementation, the ceiling installation 100*a* is suspended below a ceiling 110*a* in a conference room or other office space. However, one will appreciate that the environments and spaces in which installations of the present disclosure are presented only as non-limiting examples.

Along these lines, an installer can incorporate one or more installations of the present disclosure into any number spaces, either commercial, residential, industrial, indoor, outdoor, or the like. In addition, an installer can use any of the implementations of collapsible acoustic honeycomb ceiling installations of the present disclosure alone or in combination with one another in any desired space.

FIG. 1A also illustrates the ceiling installation 100*a* suspended below a light source. In such an implementation, the ceiling installation 100*a* generally obscures direct views of the light source itself but allows light to be transmitted therethrough. As such, the ceiling installation 100*a* may diffuse, scatter, or otherwise aesthetically affect the way light is transmitted through the ceiling installation 100*a* and then through the room. The dotted line arrows illustrated in FIG. 1A represent light passing through the ceiling installation 100*a* from above.

For example, in one or more implementations of ceiling installations having transparent or semitransparent panels 105*a*, light can travel through panels 105*a* of the ceiling installation 100*a* to varying degrees. In this way, light illuminates the ceiling installation 100*a* to create a pleasing aesthetic effect within the room. Further, light may pass directly into the room through honeycomb cavities 115*a* formed between the assembled panels 105*a* so that the ceiling installation 100*a* does not excessively block light emanating from the light source.

FIG. 1B shows an alternative embodiment of a ceiling installation 100*b* having panels 105*b* made of textile. In the illustrated implementation, an installer has incorporated the ceiling installation 100*b* into a tile ceiling 110*b*. The installer may do so by selectively attaching the ceiling installation 100*b* between or about one or more grid frame elements 125*b* of the tile ceiling 110*b*. The process by which an installer installs a ceiling installation into a tile ceiling 110 is described below in further detail. However, FIG. 1B illustrates one example of such a ceiling installation 100*b*. One will appreciate that the placement and size of such a ceiling installation 100*b* may vary in other implementations.

For example, in one implementation, the ceiling installation 100*b* may be the same size as one of the ceiling tiles 130. In one or more implementations, the ceiling installation 100*b* may span multiple tiles 130. In the illustrated implementation of FIG. 1B, the ceiling installation 100*b* spans at least three tiles 130 in both directions. A manufacturer and/or installer can customize the size of the ceiling installation 100*b* by varying the number and size of the panels 105*b* used to form the installation 100*b*.

Furthermore, in contrast to the ceiling installation 100*a* illustrated in FIG. 1A, the ceiling installation of FIG. 1B is disposed around a light source 120*b* so as not to obstruct the light source 120*b* from view. Also, as seen in FIG. 1B, the ceiling installation 100*b* can abut or accommodate other ceiling elements, such as the vents 135 shown. In one or more implementations, the ceiling installation 100*b* may surround one or more of these other elements, similar to the ceiling installation 100*b* surrounding the light source 120*b* as shown.

As another example, FIG. 1C illustrates an implementation of a collapsible acoustic honeycomb ceiling installation 100*c* made of thermoplastic 100*c*. As shown previously, the ceiling installations 100*a*, 100*b* illustrated in FIGS. 1A and 1B comprise generally flat overall profiles across the bottom surface of each ceiling installation 100*a*, 100*b*. Alternatively, as shown in FIG. 1C, one or more implementations of collapsible acoustic honeycomb ceiling installations 100*c* may comprise curvilinear or otherwise contoured surfaces.

For example, the ceiling installation 100*c* illustrated in FIG. 1C comprises an arcuate bottom surface that extends below the surface of the ceiling 110*c*, and corresponding grid frame elements 125*c*, in which the ceiling installation 100*c* resides as a drop-in installment. The illustrated ceiling installation 100*c* thus forms a wave pattern.

In order to form the curved features of the ceiling installation 100*b*, a manufacturer or installer can form and assemble panels 105*c* of the ceiling installation 100*c* with varying curved features and dimensions. For example, as shown in FIG. 1C, each panel 105*c* may vary in height along the length of the panel 105*c*, and thus along the length and/or width of the installation 100*c*. Some panels 105*c*, on the other hand, may have constant heights, with each panel 105*c* having different heights along the length and/or width of the ceiling installation 100*c*. With such a variety of panel shapes and sizes, a manufacturer and/or installer can assemble the various panels 105*c* together to form various curved surfaces of the ceiling installation 100*c*.

Further, as shown in FIGS. 1A-1C, collapsible acoustic honeycomb ceiling installations 100*a-c* may be fitted into a wide variety of ceiling types. Although FIGS. 1A-1C show ceiling installations 100*a-c* that are installed to replace only a part of the ceiling, one will appreciate that the present invention is not so limited. The ceiling installations 100*a-c* may replace any or all parts of a ceiling. Further, the shape and design of the collapsible ceiling installations 100*a-c* are not limited to those shown in FIGS. 1A-1C.

For example, in one or more implementations, the curved surface of a ceiling installation may comprise curved profiles and surfaces other than the curved surface of the ceiling installation 100*c* illustrated in FIG. 1C. In addition, one or more implementations of ceiling installations described herein may comprise a combination of flat, curved, and/or other contoured features. Further, the materials of each panel of one or more implementations of an installation may be mixed and matched in a single installation. For example, in one implementation, an installation may comprise one or more textile panels, one or more thermoplastic panels, one or more composite panels, and/or various combinations thereof.

In addition, the ceiling installations 100*a-c* illustrated in FIGS. 1A-C comprise panels 105*a-c* that are generally assembled perpendicular to one another. In this way, the honeycomb cavities 115*a-c* formed between panels 105*a-c* are generally square or rectangular. However, one or more implementations of installations described herein may comprise panels that are disposed at non-perpendicular angles relative to one another.

Along these lines, the ceiling installations 100*a-c* illustrated in FIGS. 1A-C include panels 105*a-c* disposed generally vertical when assembled. However, one or more implementations of the present disclosure may comprise panels disposed at angles relative to the vertical. By varying the angles at which various panels of an installation are disposed relative to one another and/or relative to the vertical, an installer and/or manufacturer can form a variety of ceiling installation configurations having a variety of honeycomb cavity shapes.

Figure 2A:
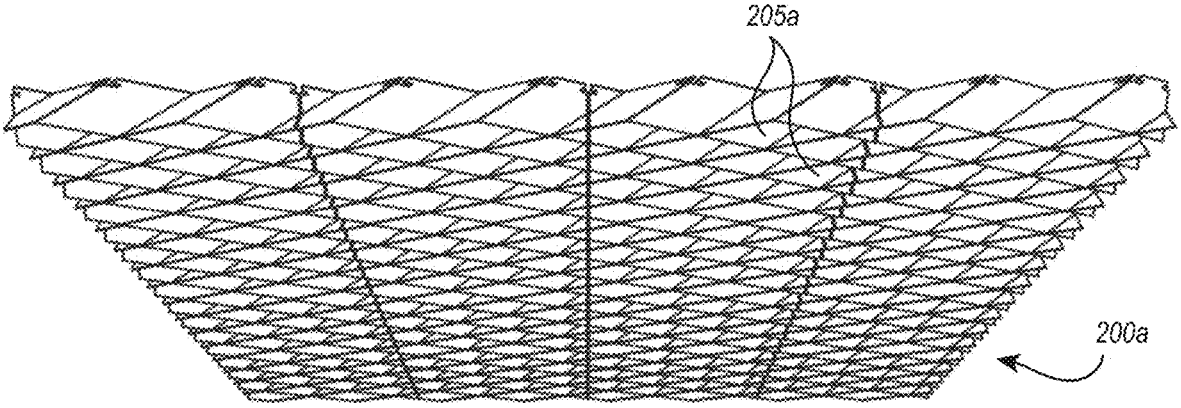
FIG. 2A illustratess an exemplary collapsible acoustic honeycomb ceiling installation with an angled pattern configuration.
Figure 2B:
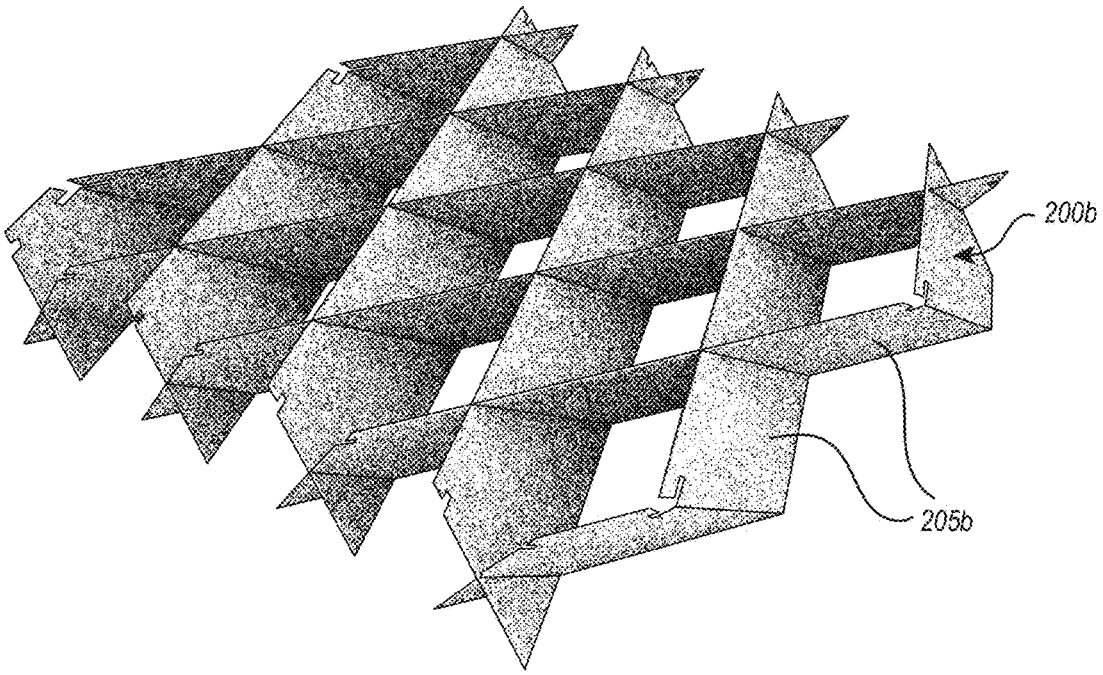
FIG. 2B illustrates an exemplary collapsible acoustic honeycomb ceiling installation made of textile with an angled pattern configuration.
Figure 2C:
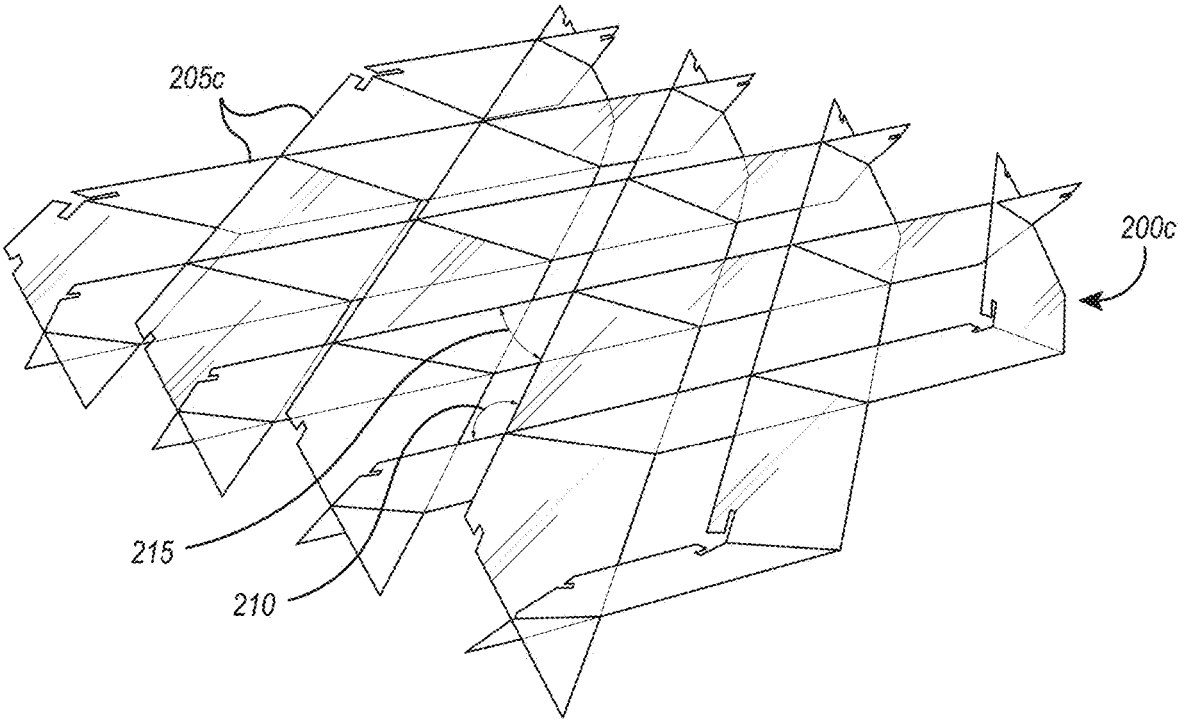
FIG. 2C illustrates an exemplary collapsible acoustic honeycomb ceiling installation made of thermoplastic with an angled pattern configuration.

For example, FIGS. 2A-C show exemplary collapsible acoustic honeycomb ceiling installations 200*a-c* with angled pattern configurations. Specifically, FIG. 2A illustrates a ceiling installation 200*a* with an angled pattern configuration. In such an implementation, the panels 205*a* of the ceiling installation 200*a* are disposed at non-perpendicular angles relative to one another. In addition, the panels 205*a* are angled other than vertical. One will appreciate that a manufacturer can angle the panels 205*a* of a ceiling installation, such as the ceiling installation 200*a* illustrated in FIG. 2A, either at non-perpendicular angles relative to one another, non-perpendicular angles relative to the vertical, or both.

As shown the angled panels 205*a* form diamond shaped honeycomb cavities 215*a* between the assembled panels 205*a*. To more clearly illustrate the angled panels 205*a*, FIG. 2B illustrates at least a portion of a ceiling installation 200*b* with an angled pattern configuration made of textile 200*a*. The panels 205*b* of the installation 200*b* illustrated in FIG. 2B form non-vertical diamond shaped honeycomb cavities 215*b* between the assembled panels 205*b*. As seen in FIG. 2*b*, the angled panels 205*b* may create unique shadow effects within the honeycomb cavities 205*b*. In addition, the angled panels 205*b* of the ceiling installation 200*b* may obscure light sources directly above an installed ceiling installation 200*b*, even when looking straight up at the ceiling installation 200*b*.

Similarly, FIG. 2C shows a ceiling installation 200*c* with an angled pattern configuration, but with thermoplastic panels 205*b*. A manufacturer can cut and bend individual panels 205*b* of textile or thermoplastic into a desired shape. Again, FIGS. 2B-C show that the manufacturer and/or installer can attach the panels 205*c* to one another at non-perpendicular angles. In this way, manufacturers and/or installers can create obtuse angles 210 and acute angles 215 between assembled panels 205*c*.

However, the shape and size of the cut panels are not limited to those shown in FIGS. 2B-2C. Also, the collapsible ceiling installations 200*b-c* with an angled pattern configuration are not limited to the 4×4 panel configuration shown in FIGS. 2B-2C—any number of panels may be used. In one or more implementations, the overall size of the collapsible ceiling installations 200*a-c* with an angled pattern configuration is 2'×2'. In an alternative implementation, the ceiling installation 200*a-c* with an angled pattern configuration is 2'×4'. In yet another implementation, the ceiling installations 200*a-c* with an angled pattern configuration are 4'×4', 4'×6', 6'×6', 6'×8' or 8'×8'.

One will appreciate that a manufacturer can form the panels 205*a-c* so that the installations 200*a-c* have any number of different dimensions, including lengths and/or widths of between less than 1-foot and greater than 10-feet, 15-feet, or even 20-feet. The dimensions listed herein are for illustrative purposes only and are not meant to be limiting. Thus, the manufacturer can form panels of any of the installations described herein, including those shown in FIGS. 1A-7C, to have any desired dimension.

The dimensions of the ceiling installations may depend on the needs of the customer or the dimensions of the ceiling in which the ceiling installations are to be installed. Thus, the manufacturer and/or assembler of the various ceiling installations described herein can customize any ceiling installation to a desired size, shape, and configuration. This includes ceiling installations formed with angled configurations, as shown in FIGS. 2A-2C, as well as ceiling installations having straight pattern configurations with panels disposed perpendicular to one another.

Figure 3A:
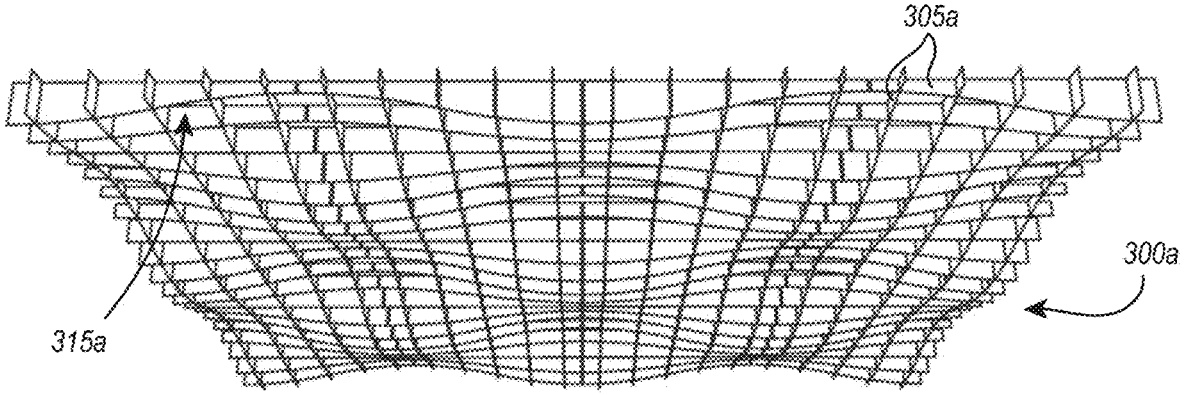
FIG. 3A illustrates an exemplary collapsible acoustic honeycomb ceiling installation with a straight pattern configuration.
Figure 3B:
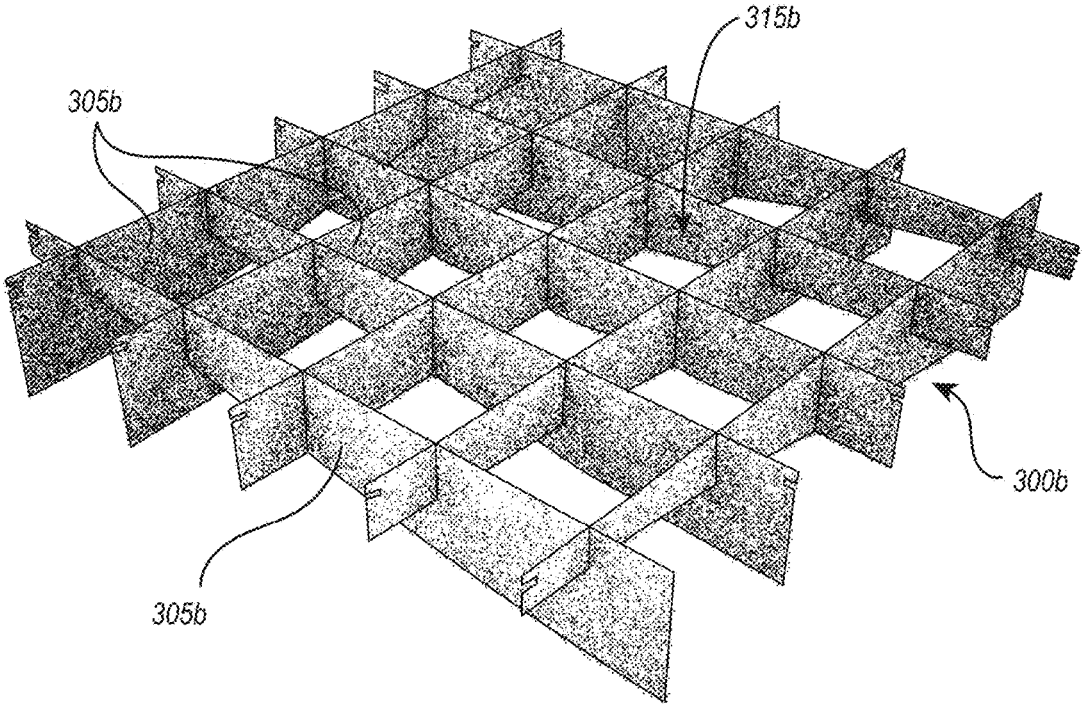
FIG. 3B illustrates an exemplary collapsible acoustic honeycomb ceiling installation made of textile with a straight pattern configuration.
Figure 3C:
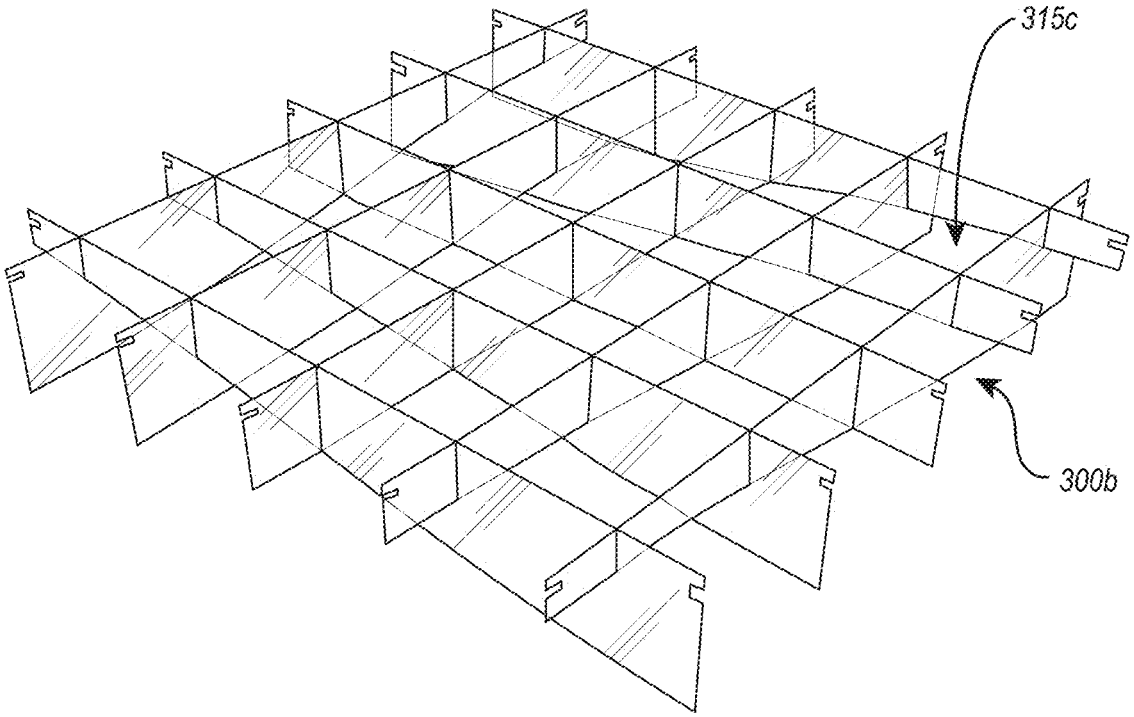
FIG. 3C illustrates an exemplary collapsible acoustic honeycomb ceiling installation made of thermoplastic with a straight pattern configuration.

Along these lines, FIGS. 3A-3C show exemplary collapsible acoustic honeycomb ceiling installations 300*a-c* with straight pattern configurations. Straight pattern configurations may include panels 305*a-c* disposed generally perpendicular to one another. Again, these straight pattern configurations form generally square honeycomb cavities 315*a-c* between the panels 305*a-c*. FIGS. 3A-3C also illustrate ceiling installations 300*a-c* having curvilinear surfaces. For example, FIG. 3A illustrates a ceiling installation 300*a* having wavy configuration with a plurality of curvilinear waves extending thereacross.

To further illustrate how a manufacturer can form such a wavy surface, FIG. 3B shows a portion of a ceiling installation 300*b* similar to the ceiling installation 300*a* illustrated in FIG. 3A. The ceiling installation 300*b* of FIG. 3B comprises panels 305*b* assembled generally perpendicular to one another to form generally square honeycomb cavities 315*b*. The illustrated panels 305*b* may comprise textile materials.

In order to form a wavy pattern, the manufacturer can form each panel 305*b* to vary in height along the length of each panel 305*b*. For example, each panel 305*b* of the ceiling installation 300*b* shown in FIG. 3B tapers curvilinearly from one end to another. In this way, the height of each panel 305*b* varies along the length of each panel 305*b*. In one implementation, the manufacturer can form one or more panels 305*b* of the ceiling installation 300*b* to increase and decrease repeatedly the length of each panel 305*b*. In such an implementation, each panel 305*b* of the ceiling installation 300*b* may comprise wavy profiles along the length of each panel 305*b*.

Once the manufacturer forms the panels 305*b* in such a way, the manufacturer and/or installer can assemble the panels 305*b* together to form a wave pattern across the surface of the ceiling installation 300*a*, as seen in FIG. 3A. Along these same lines, FIG. 3C shows a ceiling installation 300*c*, or at least a portion thereof, with a straight pattern configuration made of thermoplastic 300*b*. Similar to the ceiling installation 300*b* illustrated in FIG. 3B, the ceiling installation 300*c* can comprise panels 305*c* having various tapers and curvilinear profiles. Thus, the ceiling installation 300*c* may also be used to form wave patterns similar to that illustrated in FIGS. 3A and 3B.

As noted above, by varying the heights of the panels 305*a-c*, a manufacturer can form ceiling installations 300*a-c* having any number contoured surfaces, including curved, stepped, triangular, or any other contoured surface configuration. In this way, the manufacturer can customize the aesthetic appearance of each ceiling installation 300*a-c* according to the end user's needs or wants. This is true for any of the ceiling installations described herein.

Like collapsible ceiling installations 200*a-c* with angled pattern configurations, the collapsible ceiling installations 300*a-c* with straight pattern configurations are not limited to the shape and size of the cut panels shown in FIGS. 3A-3C. The collapsible ceiling installations 300*a-c* with a straight pattern configuration are also not limited to the 5×5 panel configuration shown in FIGS. 3B-3C—any number of panels may be used. In at least one implementation, the overall size of the collapsible ceiling installations 300*a-c* with straight pattern configurations is 2'×2'. In an alternative implementation, the collapsible ceiling installations 300*a-c* with a straight pattern configuration is 2'×4'. In yet another implementation, the ceiling installations 300*a-c* with a straight pattern configuration can be 4'×4', 4'×6', 6'×6', 6'×8' or 8'×8'.

One will appreciate that a manufacturer can form the panels 305*a-c* so that the ceiling installations 300*a-c* have any number of different dimensions, including lengths and/or widths of between less than 1-foot and greater than 10-feet, 15-feet, or even 20-feet. The dimensions listed herein are for illustrative purposes only and are not meant to be limiting.

Regarding the textile material mentioned herein, in general, the manufacturer can use a felt material made of natural fibers, synthetic fibers, or blended fibers to make the collapsible ceiling installations 200*b*, 300*b* in FIGS. 2B and 3B. One or more implementations of ceiling installations 200*b*, 300*b* described herein may comprise other suitable textile materials or combinations thereof. For example, the manufacturer can use natural textile materials such as wool, silk, cotton, flax, jute, asbestos, glass fibers or the like. Also, for example, the manufacturer can use synthetic fibers such as nylon, polyester, or acrylic, or combinations thereof. The manufacturer can also use other textile materials commonly known to those of ordinary skill in the art.

Regarding the thermoplastic materials mentioned herein, in general, the manufacturer can use polycarbonate, acrylic, polyvinylchloride, polyamide, cellulosic, styrene, polyethylene, or the like to make the collapsible ceiling installations 200*c*, 300*c* illustrated in FIGS. 2C and 3C. In one or more implementations, the manufacturer can use a combination of thermoplastic materials to form the panels 205*c*, 305*c*. In at least one implementation, the thermoplastic used is a co-polyester resin. Co-polyester resins generally have low-thermoforming temperatures and are therefore easy to strip heat and line bend.

As noted above, the various materials used for ceiling installations of the present disclosure may affect the light and acoustic properties of a room. The manufacturer can select materials that alter or maintain such conditions according to the end user's needs. For example, the manufacturer may choose to form panels from sound absorbing materials to dampen sounds within a room. Alternatively, the manufacturer can select materials to form the panels of an installation to maintain the acoustic properties of a room. In this way, the end user can customize a ceiling with the installations described herein without altering the acoustics within a room. Additionally, manufacturers can select materials that reflect sound waves to a greater degree to alter the acoustics of a room.

One skilled in the art will appreciate that although FIGS. 2B-2C and FIGS. 3B-3C show collapsible ceiling installations made only from textile and thermoplastic, the present invention is not so limited. The manufacturer may also use a composite material of bonded textile and thermoplastic to make a collapsible ceiling installation, or any other suitable material.

Further, the present invention is not limited to the pattern configurations shown in FIGS. 2A-2C and 3A-3C. A manufacturer and/or installer can assemble the cut panels 205*a-c*, 305*a-c* in any pattern configuration that allows the ceiling installations 200*a-c*, 300*a-c* to remain collapsible. For example, the manufacturer can cut the panels 205*a-c*, 305*a-c*, into uniform sizes and/or shapes, or cut the panels to add additional decorative features to the collapsible ceiling installations 200*a-c*, 300*a-c*.

Figure 4:
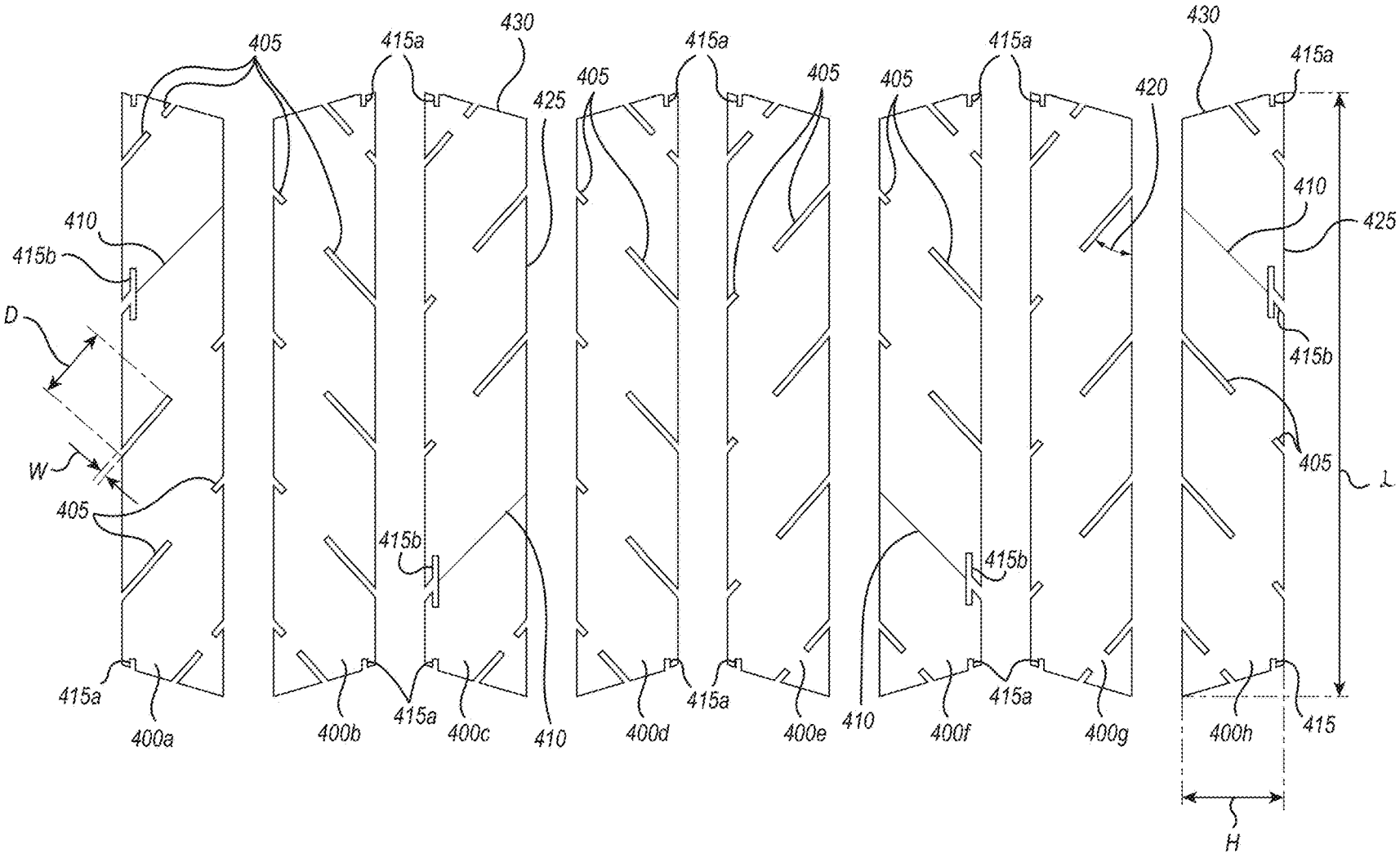
FIG. 4 illustrates an exemplary cutting blueprint used to make a collapsible acoustic honeycomb ceiling installation with an angled pattern configuration.
Figure 5A:
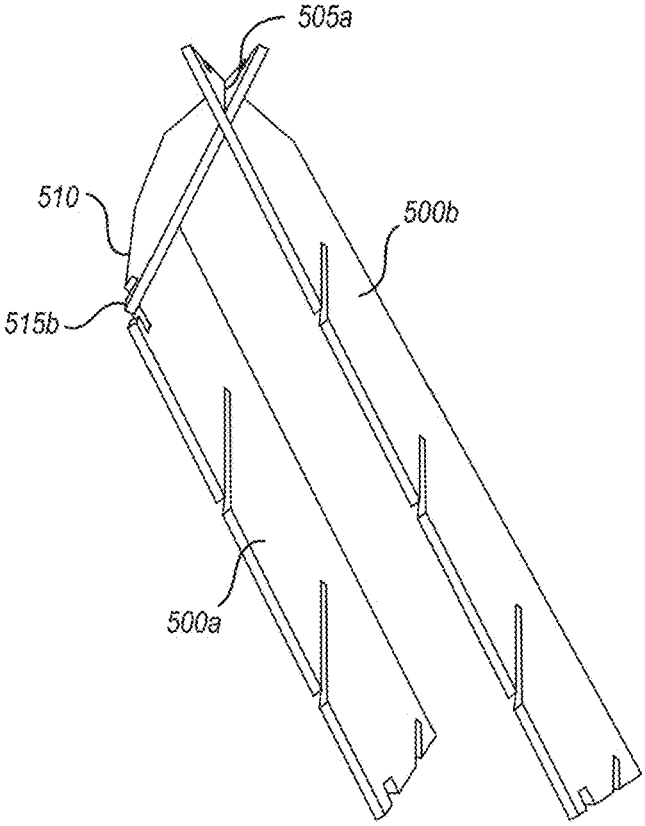
FIG. 5A illustrates an exemplary assembly process of a collapsible acoustic honeycomb installation with an angled pattern configuration.
Figure 5B:
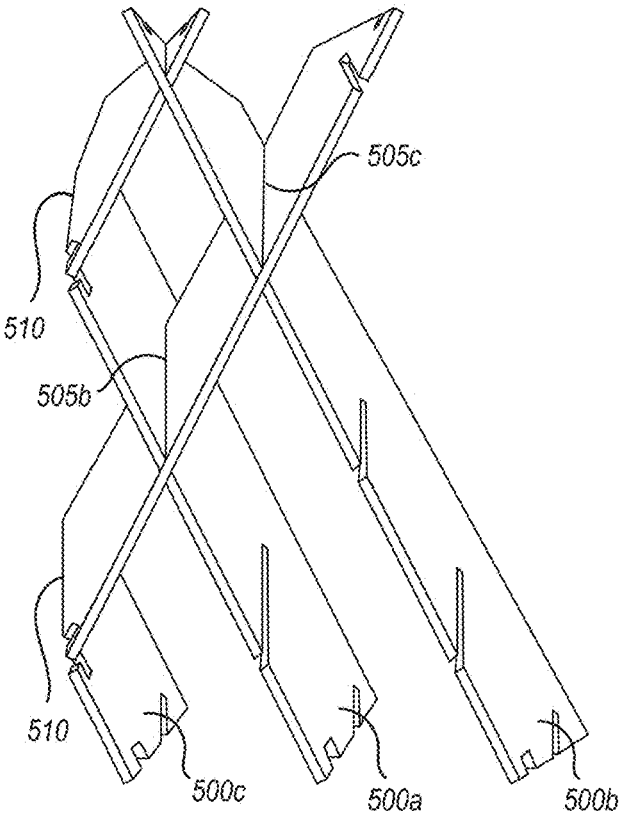
FIG. 5B illustrates the exemplary assembly process shown in FIG. 5A.
Figure 5C:
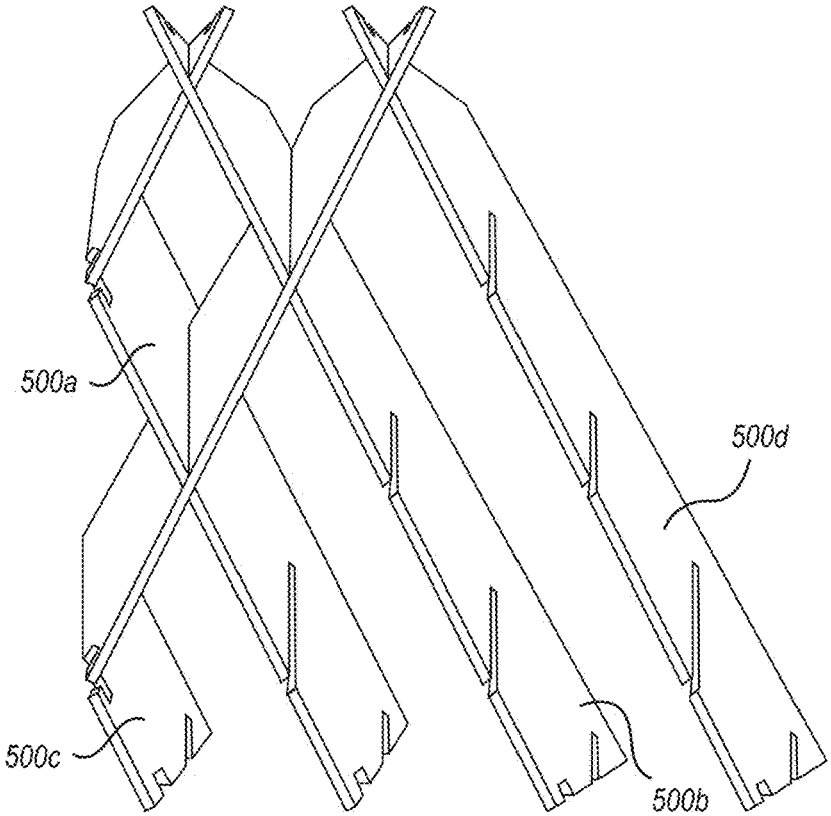
FIG. 5C illustrates the exemplary assembly process shown in FIGS. 5A-5B.
Figure 5D:
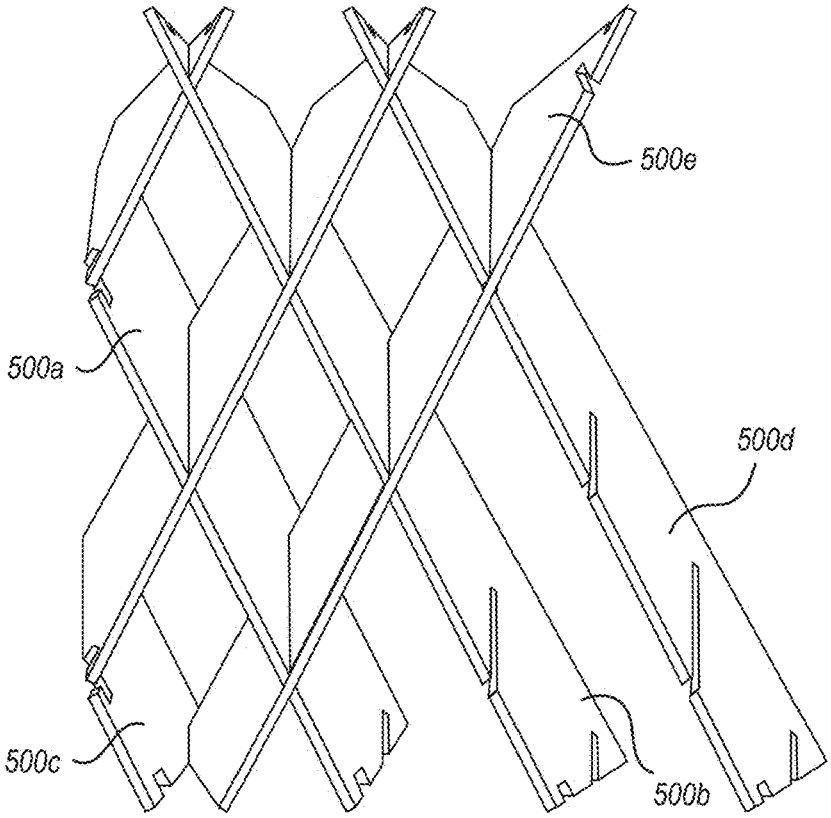
FIG. 5D illustrates the exemplary assembly process shown in FIGS. 5A-5C.
Figure 5E:
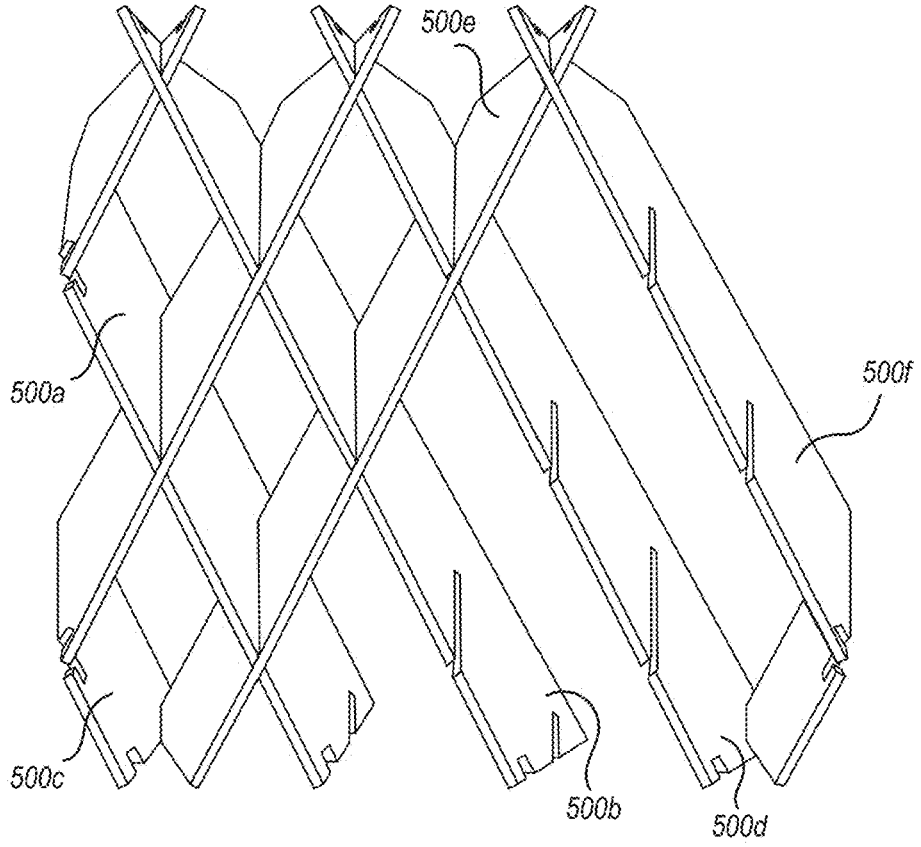
FIG. 5E illustrates the exemplary assembly process shown in FIGS. 5A-5D.
Figure 5F:
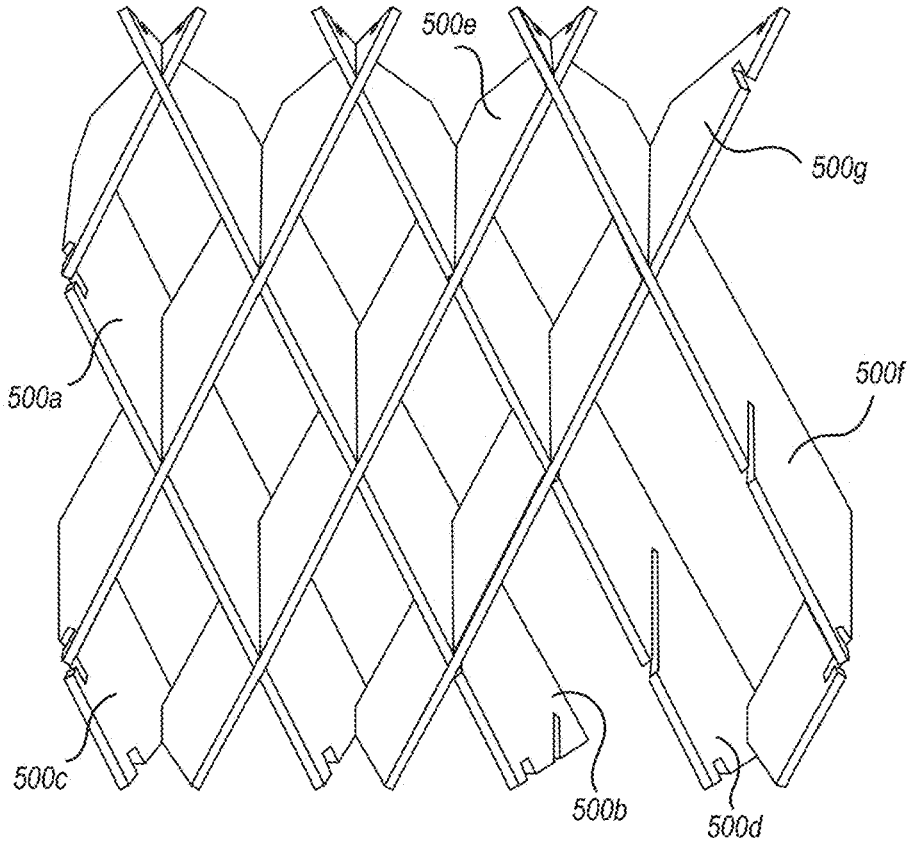
FIG. 5F illustrates the exemplary assembly process shown in FIGS. 5A-5E.
Figure 5G:
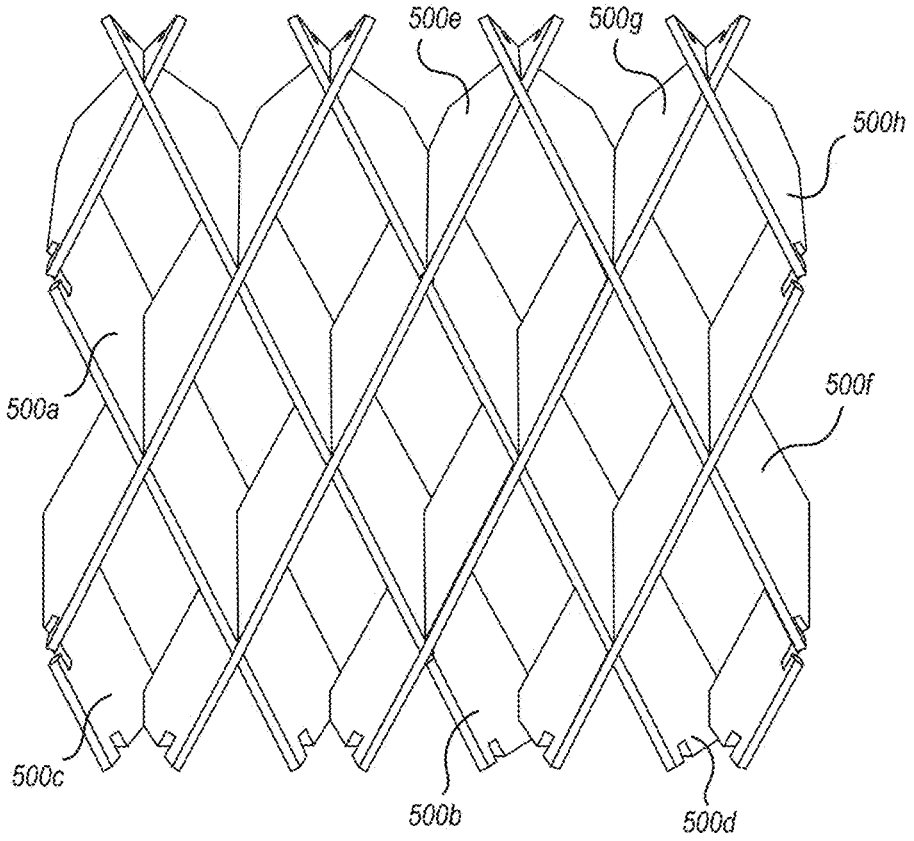
FIG. 5G illustrates the exemplary assembly process shown in FIGS. 5A-5F.

FIGS. 4-5G illustrate various features and elements of panels that enable manufacturers and/or assemblers to form the various collapsible ceiling installations disclosed herein. Specifically, FIG. 4 illustrates elevation views of eight panels 400*a-h*. Each panels 400*a-h* may comprise various assembly notches 405, grooves 410, and installment notches 415.

FIG. 4 shows an exemplary cutting blueprint for creating a collapsible acoustic honeycomb ceiling installation with an angled pattern configuration. Such angled configurations are shown and described herein at least in FIGS. 2A-2C. As shown in FIG. 4, a manufacturer can cut a desired material into panels 400*a-h*. Further, the manufacturer can cut assembly notches 405 along both longitudinal edges 425 of each of the panels 400*a-h*. As seen in FIG. 4, the manufacturer can cut some notches 405 deeper than others. Generally, a manufacturer or assembler can align a deep notch of one panel 400*a-h* with a shallow notch of another panel 400*a-h* when assembling a ceiling installation.

The angle, spacing, and depth of each assembly notch 405 may affect the overall appearance of a ceiling installation formed by the panels 400*a-h*. For example, the angle 420 at which each assembly notch 405 is disposed relative to a longitudinal edge of the panel 400*a-h* determines the angle at which the panels 400*a-h* will be disposed relative to one another when assembled. In the embodiment illustrated in FIG. 4, each assembly notch 405 is angled at a non-perpendicular angle 420 relative to the longitudinal edges 425 of each panel 400*a-h*. Alternatively, a manufacturer can form assembly notches 405 disposed perpendicularly to the longitudinal edge of each panel 400*a-h* to form a ceiling installation with a straight configuration, as described herein.

Also, for example, the distance between assembly notches 405 along the longitudinal edges of the panels 400*a-h* determines the size of each honeycomb cavity of the assembled installation. For example, the closer the assembly notches 405 are to one another, the smaller the honeycomb cavities will be. Conversely, the more space between assembly notches 405, the larger the honeycomb cavities will be.

The manufacturer can also cut angled grooves 410 into some of the panels 400*a-h*, which allow the panels 400*a-h* to bend where the angled grooves 410 are cut. In one or more implementations, the angled grooves 410 are formed only partially into the thickness of the panels 400*a-h*. In one or more implementation, the angled grooves 410 may comprise perforations. In any case, the angled grooves 410 comprise a flexible portion of the panel 400*a-h* at which an assembler can bend the panel 400*a-h*.

Specifically, when assembling an angled configuration ceiling installation, such as that shown in FIGS. 2A-2C, an assembler may need to bend one or more of the panels 400*a-h* at the angled groove 410 when assembling the panels 400*a-h* together. This assembly process will be described in more detail below with reference to FIGS. 5A-5G. Alternatively, in one or more implementations such as straight configurations of ceiling installations, the panels 400*a-h* may not include any angled grooves 410. This is because in such implementations, like the ceiling installations 300*a-c* shown in FIGS. 3A-3C, an assembler does not need to bend any of the panels 305*a-c* to form the ceiling installation 300*a-c*.

Finally, the manufacturer can cut installment notches 415 into the panels. In one implementation, the manufacturer can form one or more installment notches 415*a* into transverse edges 430 of each panel 400*a-h*. Also, a manufacturer may cut one or more t-shaped installment notches 415*b* into a longitudinal edge of each panel 400*a-h* having an angled groove 410. The t-shaped installment notches 415*b* formed along longitudinal edges 425 of panels 400*a-h* having angled grooves 410 correspond in position with the angled grooves 410.

In this way, each installment notch 415 is positioned on the panels 400*a-h* so that each installment notch 415 will be disposed at an outer edge of a ceiling installation when a manufacturer assembles the panels 400*a-h* together. For example, when an assembler or manufacturer bends a panel 400*a-h* at an angled groove 410, the t-shaped assembly notch 415*b* will be positioned at an outer edge of the assembled ceiling installation. Again, more detail regarding the assembly process is given below with reference to FIGS. 5A-5G. However, it is noted here that the manufacturer can thus position the installment notches 415 to be disposed at an outer edge of an assembled ceiling installation. In this way, because all the assembly notches 415 are disposed about an outer edge of a ceiling installation, an installer can use the installment notches 415 to conveniently secure the collapsible acoustic honeycomb ceiling installation to existing ceiling frame elements that may surround the assembled ceiling installation.

One skilled in the art will appreciate that the cutting blueprint shown in FIG. 4 is just one implementation of the present invention. The present invention is not limited to the size, shape, placement, or number of the panels 400*a-h*, assembly notches 405, angled grooves 410, or installment notches 415 shown in FIG. 4.

In one exemplary ceiling installation having felt panels 400*a-h* and an angled configuration, a height H of each panel may be about 4.75-inches. Also, the length of each panel 400*a-h* in such an implementation may be about 28-inches. A thickness of each panel 400*a-h* in such an implementation may be about 4.5 mm and a width W of each assembly notch 415 may be about 3/16-inches. Additionally, a depth D of each assembly notch 415 may be about 3⅝-inches.

One will also appreciate that the various dimensions of felt panels 400*a-h* described herein are for illustrative purposes only and may vary in other implementations. For example, in one implementation, a height H of each panel may be between 1-inch and 7-inches. Alternatively, one or more implementations of panels 400*a-h* may have a height H between 2-inches and 6-inches, or between 3-inches and 5-inches. One or more implementations may have a height of greater than 7-inches.

Also, in one implementation of a ceiling installation having felt panels 400*a-h*, each panel 400*a-h* may have a length L of between 16-inches and 40-inches. Alternatively, each panel 400*a-h* may have a length L of between 20-inches and 36-inches, between 24-inches and 32-inches, less than 16-inches or greater than 40-inches. Further, one or more implementations of panels 400*a-h* may have a thickness of between 2 mm and 7 mm, between 3 mm and 6 mm, or between 4 mm and 5 mm.

In addition to the height H, length L, and thickness of each panel 400*a-h* described above, other implementations may have varying depths D and widths W of assembly notches 415. For example, in one or more implementations, assembly notches 415 may have a width of between 1/16-inches and 5/16-inches or between 2/16-inches and 4/16-inches. Further, one or more implementations of panels 400*a-h* may have assembly notches 415 having a depth D of between 1-inch and 6-inches, between 2-inches and 5-inches, or between 3-inches and 4-inches.

One will appreciate that the various dimensions noted above with reference to felt panels 400*a-h* may vary depending on the material used to form the panels 400*a-h*. For example, in an exemplary ceiling installation having panels 400*a-h* made of a thermoplastic material such as PETG, a thickness of each panel 400*a-h* may preferably be about ⅛-inches. In this way, the panels 400*a-h* may remain sufficiently flexible so that an installer or manufacturer can collapse a ceiling installation comprising PETG panels 400*a-h*.

In such an implementation of PETG panels 400*a-h*, a height H of each panel may be about 4.75-inches. Also, the length of each panel 400*a-h* in such an implementation may be about 28-inches. Further, a width W of each assembly notch 415 may be about ⅛-inches. Additionally, a depth D of each assembly notch 415 may be about 3⅝-inches.

One will appreciate that the various dimensions of PETG panels 400*a-h* described herein are for illustrative purposes only and may vary in other implementations. For example, in one implementation, a height H of each panel may be between 1-inch and 7-inches. Alternatively, one or more implementations of panels 400*a-h* may have a height H between 2-inches and 6-inches, or between 3-inches and 5-inches. One or more implementations may have a height of greater than 7-inches.

Also, in one implementation of a ceiling installation having PETG panels 400*a-h*, each panel 400*a-h* may have a length L of between 16-inches and 40-inches. Alternatively, each panel 400*a-h* may have a length L of between 20-inches and 36-inches, between 24-inches and 32-inches, less than 16-inches, or greater than 40-inches. Further, one or more implementations of PETG panels 400*a-h* may have a thickness of between 1/16-inches and ¼-inches, between 3/32-inches and 3/16-inches, or between 3/32-inches and 5/32-inches.

In addition to the height H, length L, and thickness of each panel 400*a-h* made from PETG described above, other implementations may have varying depths D and widths W of assembly notches 415. For example, in one or more implementations, assembly notches 415 may have a width of between 1/16-inches and ¼-inches, between 3/32-inches and 3/16-inches, or between 3/32-inches and 5/32-inches. Further, one or more implementations of PETG panels 400*a-h* may include assembly notches 415 having a depth D of between 1-inch and 6-inches, between 2-inches and 5-inches, or between 3-inches and 4-inches.

Along these lines, the dimensions of ceiling installations and panels thereof described herein provide panels large enough to form portions or all of a ceiling within a room. As such, ceiling installations of the present disclosure are large enough to be economically used in large spaces. Typical ceiling installations and systems presently available in the art are similar in scale to the ceiling installations of the present disclosure. However, as noted above, the size and scale of such ceiling installations and systems currently available in the art make it difficult for manufacturers and installers to form them in a way that enables collapsibility, modularity, disassembly, and reconfigurability, without negatively impacting functionality.

In contrast, the ceiling installations of the present disclosure maintain the size and scale necessary to adequately form ceilings, as noted by the dimensions given above, with the advantage of being collapsible, modular, reconfigurable, and customizable. These advantages allow a manufacturer, assembler, or installer to collapse and reduce the volume of ceiling installations. As noted above, this reduction in volume saves shipping and handling costs and simplifies installation methods for manufacturers and installers. Thus, the collapsibility of such large ceiling installations provides a number of advantages without sacrificing functionality or aesthetic qualities of the installations.

As well, it will be appreciated that aspects such as the dimensions and configurations of the example panels disclosed herein are not arbitrarily selected but are instead a function of the particular disclosed applications to which such panels are intended to be put to use. Thus, such dimensions and configurations would not be arrived at simply by extrapolating from the dimensions and/or configurations of any existing conventional structures that are used for different purposes and applications than the panels disclosed herein. That is, such dimensions and configurations are not merely a matter of design choice. Nor, in view of these points, would a person of ordinary skill in the art have any reason to modify the size and/or configuration of such conventional structures as may exist in an attempt to arrive at panels of the sizes and configurations disclosed herein.

To further illustrate these advantages, FIGS. 5A-6C illustrate methods of assembling, collapsing, and installing ceiling installations of the present disclosure. First, FIGS. 5A-5G show an exemplary process of assembling a collapsible acoustic honeycomb ceiling installation 500 with an angled pattern configuration made of textile panels 505*a-h*. The panels 505*a-h* of FIGS. 5A-5G may correspond with the panels 400*a-h* shown in FIG. 4, respectively. This is for illustrative purposes only, as a manufacturer may use many different cut patterns and configurations to form ceiling installations using a method similar to that shown in FIG. 5A-5G.

As shown in FIGS. 5A-5G, panels 500*a-h* are progressively added by aligning assembly notches 505 and sliding the panels 500*a-h* together. Although FIGS. 5A-5G shows the assembly of a collapsible acoustic honeycomb ceiling installation with an angled pattern configuration, the assembly process is similar for ceiling installations made of any material or having other patterns or configurations.

Further, as shown in FIG. 5A, an assembler joins two panels 505*a*, 505*b* together by aligning respective assembly notches 505*a* and sliding first and second panels 505*a*, 505*b* together. In addition, the assembler can bend the first panel 505*a* at the angled groove 510. As a result of the panel 500*a* having a t-shaped installment notch 515*b* corresponding in position with the angled groove 510, the t-shaped installment notch 515*b* is disposed at an outer edge of the ceiling installation when the panel 500*a* is bent at the angled groove 510.

Again, as noted above, a manufacturer can vary the depth and width of the assembly notches 505 to ensure that sufficient friction exists between the panels 500*a*, 500*b* to hold them together when an assembler slideably connects the panels 500*a*, 500*b*. These dimensions, including the width and depth of each assembly notch 405, 505 may depend on the thickness and materials of each panel 405*a-h*, 505*a-h*.

For example, a manufacturer can form thicker assembly notches 505 to accommodate thicker panels 500*a-h*, or thinner notches 505 to accommodate thinner panels 500*a-h*. Also, for example, materials having lower coefficients of friction may require thinner assembly notches 505 to increase a normal force between panels 500*a-h* when slideably connected, thus increasing the friction force that holds the panels 500*a-h* together.

Moving on to FIG. 5B, an assembler can align assembly notches 505*b*, 505*c* of a third panel 500*c* with an assembly notch 505*a*, 505*c* of the first and second panels 500*a*, 500*b*, respectively. In this way, the assembler can slide the third panel 500*c* together with the first and second panels 500*a*, 500*b* of the ceiling installation being formed. One will also note that the third panel 500*c* also comprises an angled groove 510 at which the assembler bends the third panel 500*c*.

Subsequently, as illustrated in FIGS. 5C-5G, the assembler can join the rest of the panels 500*d*-500*h* by aligning various assembly notches 505 and sliding the panels 500*a-h* together. As shown in the fully assembled ceiling installation 520 of FIG. 5G, each assembly notch 515*a*, 515*b* is disposed around an outer edge of the ceiling installation 520.

Figure 5H:
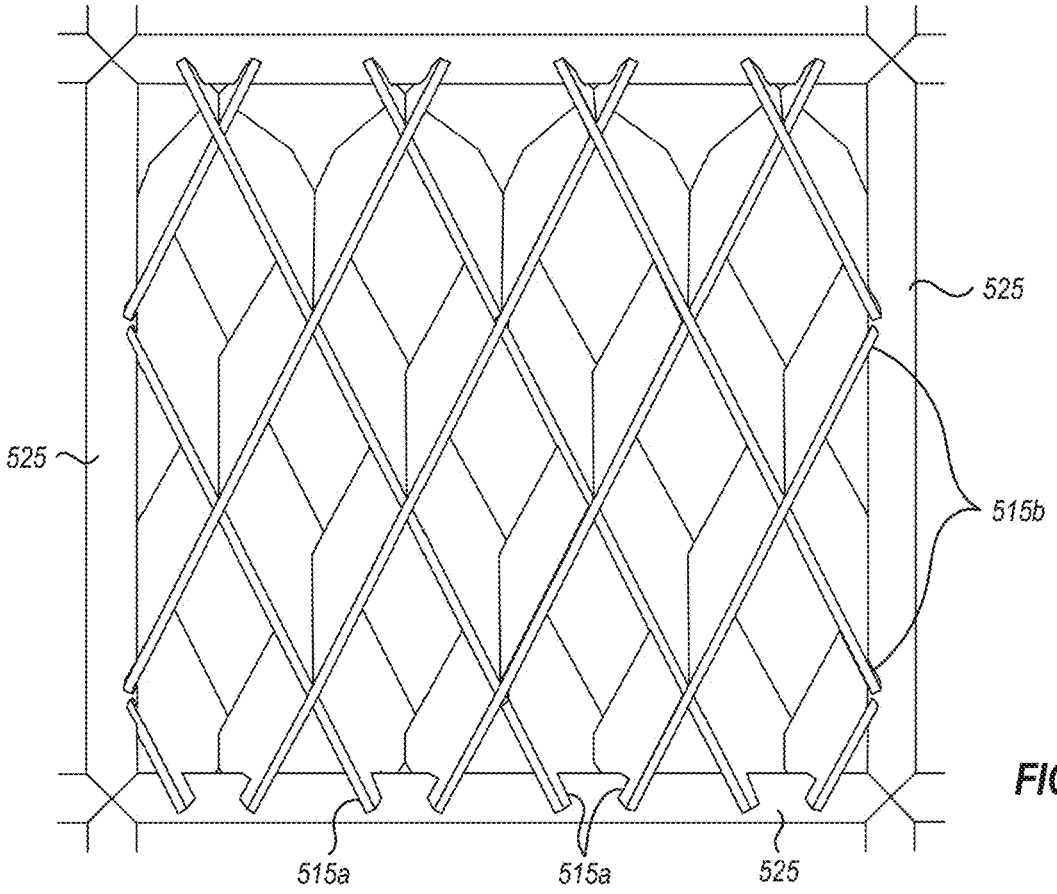
FIG. 5H illustrates an implementation of a ceiling installation formed by the exemplary assembly process shown in FIGS. 5A-5G slideably engaging grid frame elements of a ceiling.

Accordingly, as shown in FIG. 5H, an assembler or installer can insert ceiling grid frame elements 525 into the various installment notches 515*a*, 515*b* around the outer edge of the ceiling installation 520. In this way, the assembler or installer can slideably connect the ceiling installation 520 to existing grid frame elements 525 of a ceiling as a drop-in installment, as described herein.

Also, as noted above, the manufacturer can form the panels 500*a-h* and assemble them, in collapsed form, prior to shipping, or the manufacturer can ship the panels 500*a-h* in an unassembled form and let the installer assemble the panels 500*a-h* into a ceiling installation. In any case, the assembled panels 500*a-h* may form at least a portion of a collapsible ceiling installation and, as such, the assembled panels can collectively, and selectively, assume both a collapsed state, and an expanded state, depending upon the need and circumstances. Along these lines, FIGS. 6A-6C illustrates an implementation of a ceiling installation 600 that can expand and collapse.

Figure 6A:
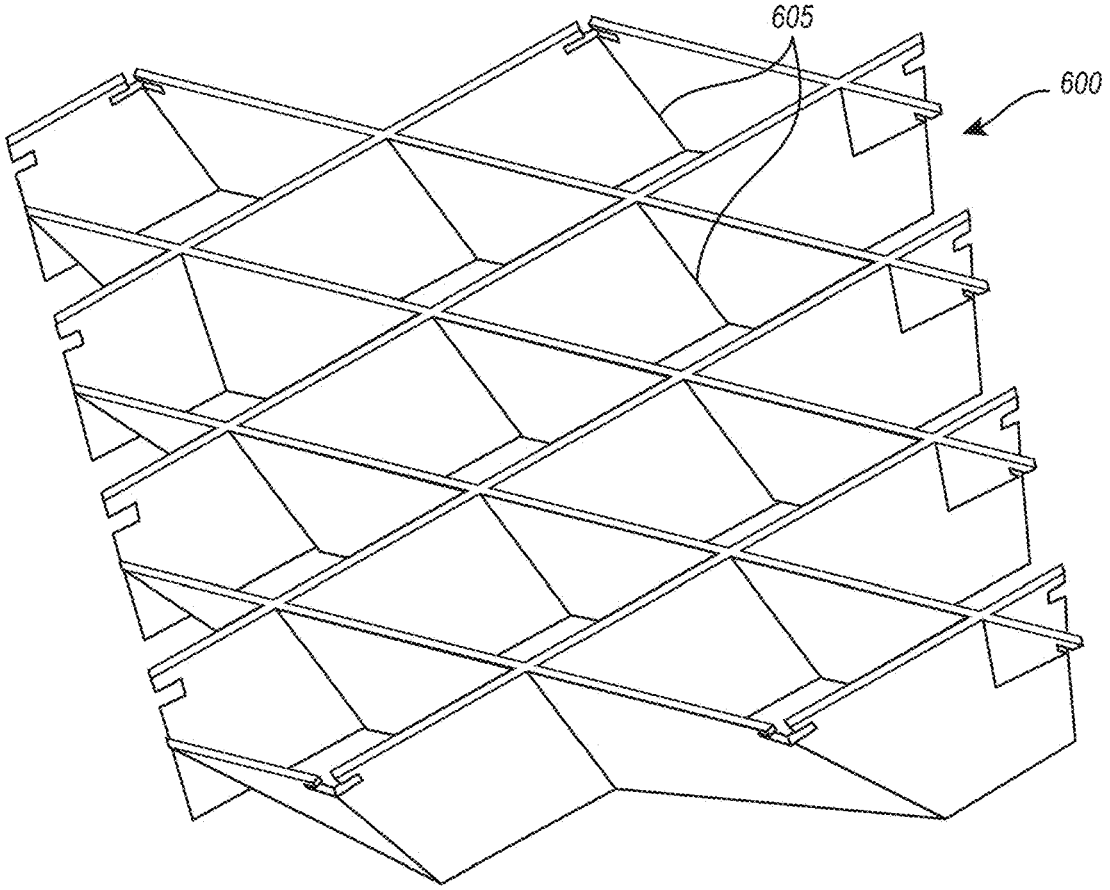
FIG. 6A illustrates an exemplary collapsible acoustic honeycomb ceiling installation made of textile with an angled pattern configuration in non-collapsed form.
Figure 6B:
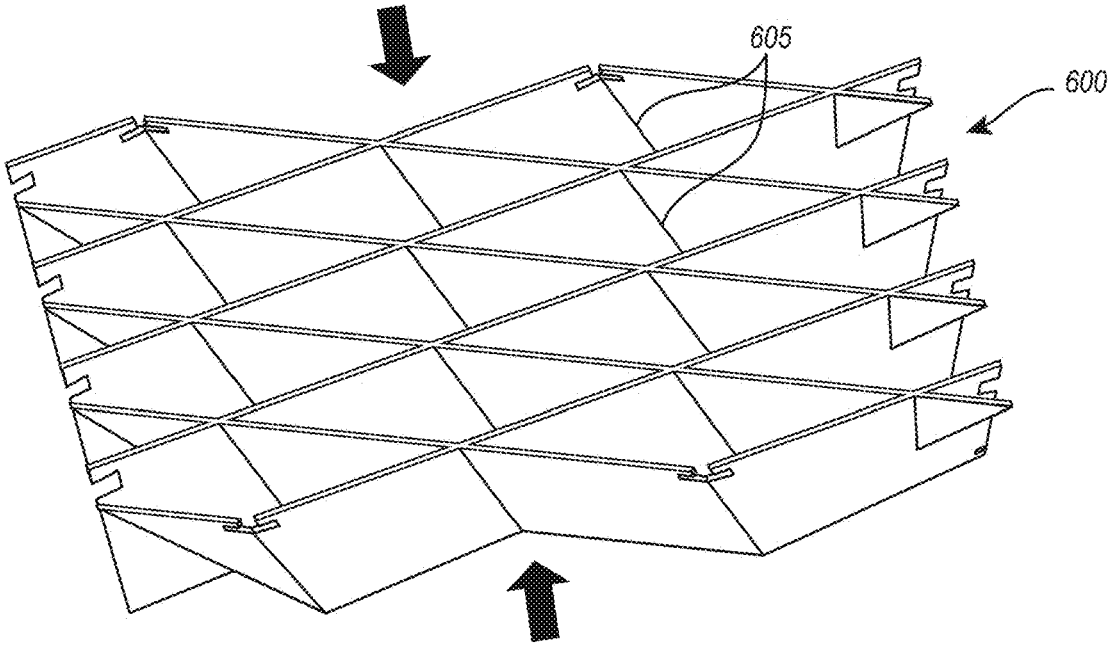
FIG. 6B illustrates the collapsible acoustic honeycomb ceiling installation of FIG. 6A in partially-collapsed form.
Figure 6C:
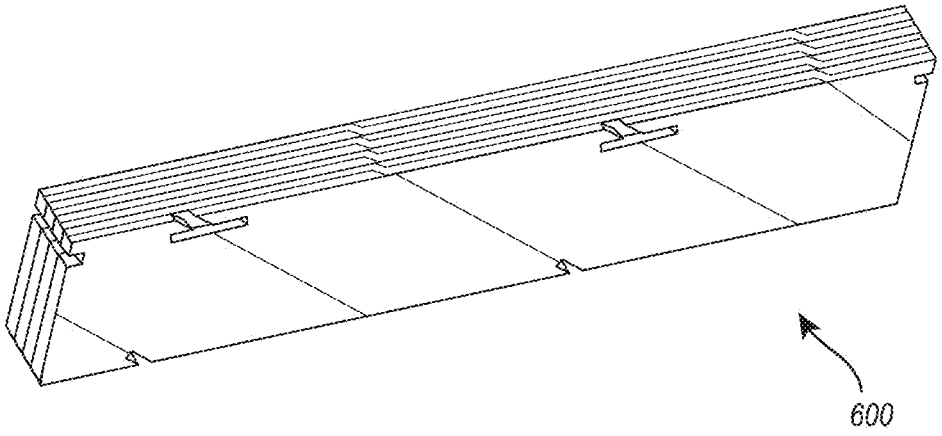
FIG. 6C illustrates the collapsible acoustic honeycomb ceiling installation of FIGS. 6A-6B in collapsed form.

Specifically, FIG. 6A illustrates a ceiling installation 600 in an expanded configuration. As shown in FIG. 6B, applying lateral force to the installation 600, as indicated by the arrows, may cause the installation to contract and begin collapsing. Finally, as shown in FIG. 6C, a manufacturer and/or installer can collapse the ceiling installation 600 completely to reduce the volume of the installation 600.

In one implementation, for example, an installer can manually collapse the installation 600 by pressing inward on opposing sides of the ceiling installation 600, as indicated by the arrows, with the installer's hands. In one implementation, the installer may use one or more hand held tools to provide the necessary lateral force. Also, in one implementation, an automated tool or machine may be used to provide the lateral force that collapses the ceiling installation 600. One will appreciate that a manufacturer or installer can use any manual method, tools, or machines to provide the lateral force on opposing sides of a ceiling installation.

A manufacturer and/or assembler can collapse the ceiling installation 600 because the panels of the installation 600 are joined together at respective assembly notches, without the use of adhesives or rigid connections, as described herein. As such, the panels can rotate relative to one another with the notches serving as axes 605 of rotation between two connected panels. Accordingly, the lateral force applied to the installation 600 causes each panel of the installation 600 to rotate relative to one another at the assembly notches where each panel is joined.

The collapsibility of each ceiling installation described herein depends on a number of factors. For example, because axes 605 of rotation are formed between panels and aligned assembly notches, each assembly notch provides enough clearance to allow rotation between two connected panels. For example, in one implementation, a width of each assembly notch is greater than a thickness of an adjoined panel such that connected panels have room to rotate about the assembly notches.

In addition to the rotation of the panels, the panels may flex as the ceiling installation 600 is collapsed. For example, with felt panels, the ceiling installation 600 may compress, in part, from rotation of the panels relative to one another, and also in part from the felt panels flex/bending as the ceiling installation is compressed. Likewise, with thermoplastic panels, such as PETG or other thermoplastic materials, the panels may also flex in addition to rotating to provide greater compressibility of the ceiling installation 600.

One will appreciate that the flexibility of materials such as PETG or other thermoplastics depends in large part on the thickness of the materials. Thus, ceiling installations comprising thermoplastic materials, or any other material for that matter, are preferably thin enough to allow the required flexibility for compressing the ceiling installation 600. Sufficient flexibility of the panels may ensure that the panels are not plastically deformed or otherwise damaged when a manufacturer or installer compresses the ceiling installation 600 in preparation for shipping and/or installation.

Referring briefly back to FIGS. 3A-3C, which illustrate ceiling installations 300*a-c* having panels 305*a-c* generally perpendicular to one another, the manufacturer may also cut installment notches in these panels that enable the collapsible ceiling installations 300*a-c* with a straight configuration to be installed. Further, the manufacturer and/or assembler can cut and assemble the panels 305*a-c* in a way that allows the ceiling installations 300*a-c* with a straight configuration to be collapsible.

Advantageously, in one or more implementations, a manufacturer and/or installer can thus collapse a ceiling installation to reduce its volume. The manufacturer may do so, for example, to reduce shipping and handling costs. Then, when an installer receives the collapsed ceiling installation, the installer can expand the ceiling installation by reversing the lateral force illustrated in FIG. 6B. In addition, in one or more implementations, the installer may temporarily collapse a ceiling installation in preparation to secure the ceiling installation within a ceiling. In this way, the installer can more easily maneuver the ceiling installation into position before expanding the ceiling installation upon securement in the ceiling.

For example, an installer may want to incorporate one or more collapsible ceiling installations into an existing grid frame of a ceiling as a drop-in installation. To do so, the installer can first collapse the ceiling installation to more easily maneuver the ceiling installation between adjacent grid frame elements of the ceiling. Once the installer has positioned the collapsed ceiling installation as desired, the installer can then expand the installation until the installment notches of the expanded ceiling installation engage with the grid frame elements of the ceiling.

In this way, the installer can easily incorporate one or more collapsible ceiling installations into an existing ceiling without altering or reassembling the ceiling or frame components thereof. This process of collapsing and expanding the ceiling installation thus saves the installer effort and time. Also, an installer can use this and other methods to incorporate a variety of collapsible installations into an existing ceiling in any number of configurations.

Figure 7A:
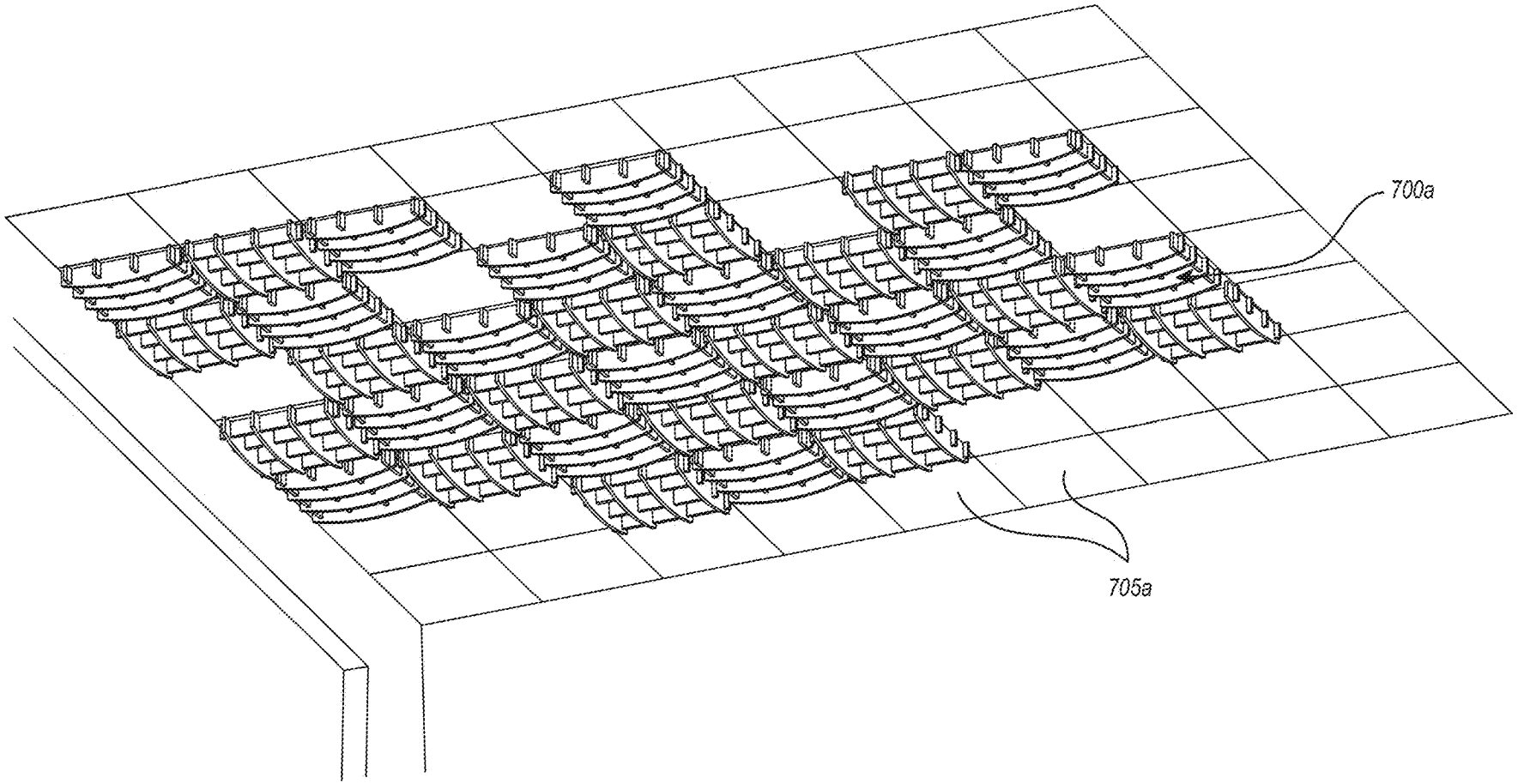
FIG. 7A illustrates an exemplary drop-in grid installation of a collapsible acoustic honeycomb ceiling installation.
Figure 7B:
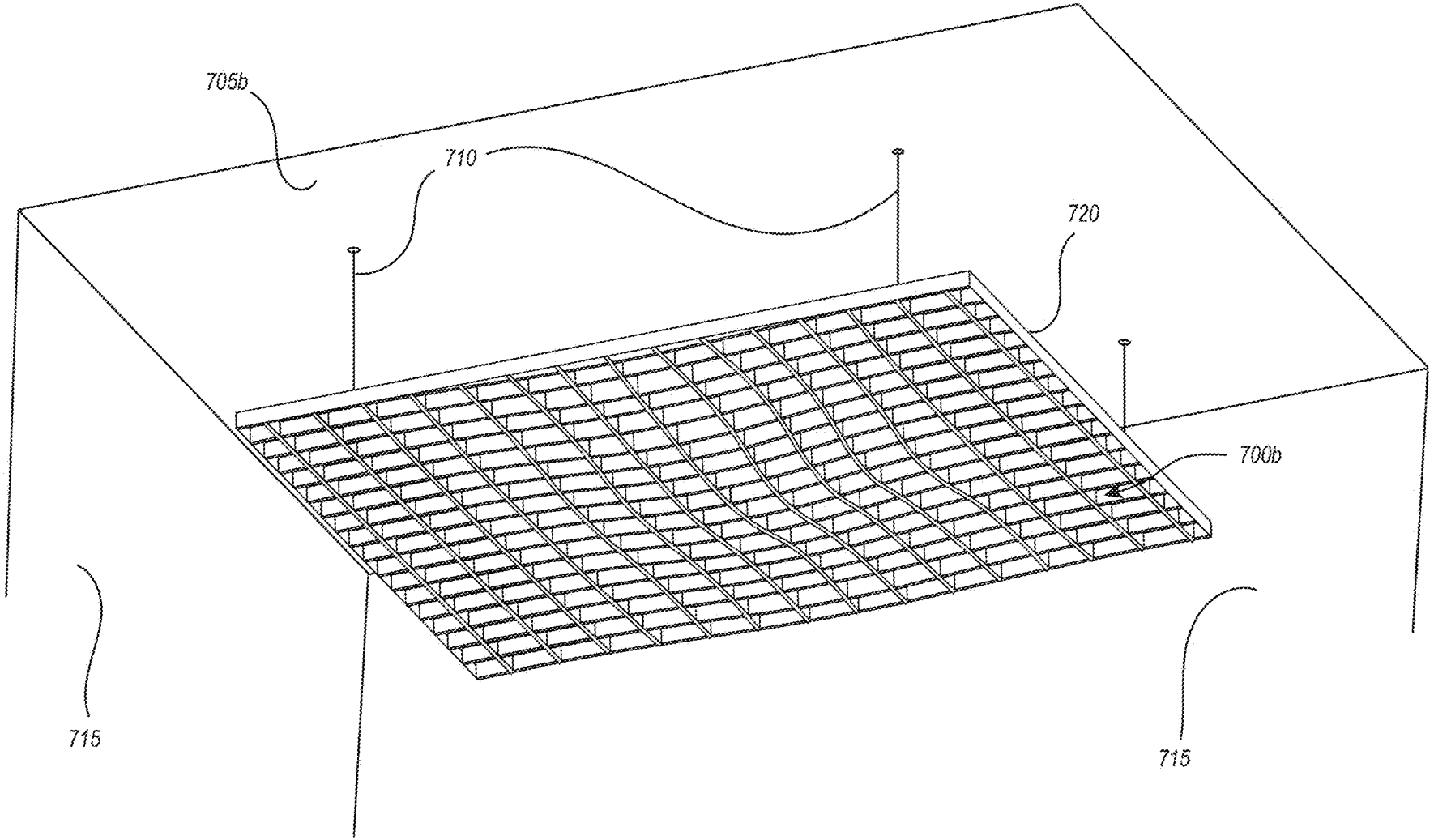
FIG. 7B illustrates an exemplary cloud installation of a collapsible acoustic honeycomb ceiling installation.
Figure 7C:
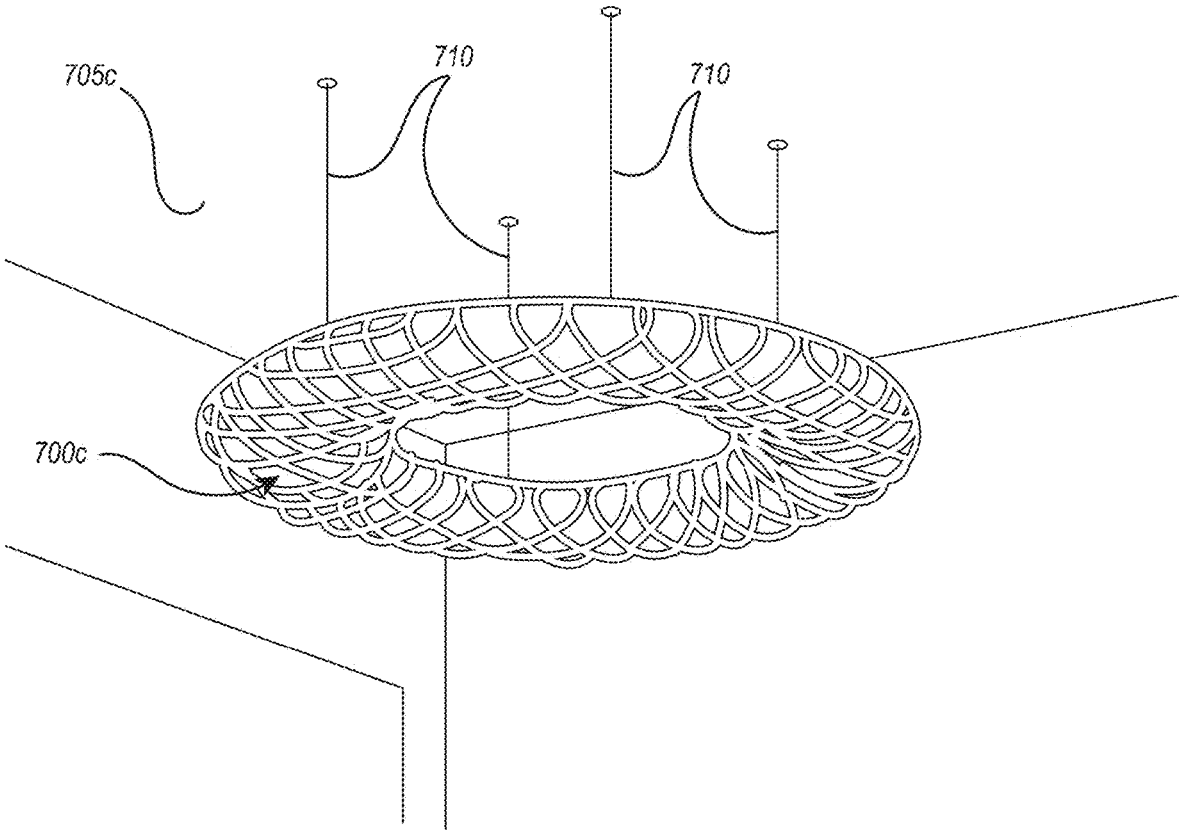
FIG. 7C illustrates an exemplary floating installation of a collapsible acoustic honeycomb ceiling installation.

Along these lines, FIGS. 7A-7C show exemplary installments of a collapsible acoustic honeycomb ceiling installation. Specifically, FIG. 7A shows an exemplary drop-in grid installment of a collapsible acoustic honeycomb ceiling installation 700*a*. As shown, the installer may install the collapsible ceiling installation 700*a* by replacing an existing ceiling tile 705*a* with the collapsible ceiling installation 700*a*. The installer can replace all existing ceiling tiles 705*a* with the collapsible ceiling installations 700*a* or create a pattern in the ceiling with the collapsible ceiling installations 700*a*, as shown in FIG. 7A.

Although FIG. 7A shows a drop-in grid installment using a collapsible acoustic honeycomb ceiling installation 700*a* with a straight pattern configuration made of textile, the present invention is not so limited. Any pattern configuration or material may be used in the drop-in grid installation 700*a*. For example, FIGS. 1B and 1C also show ceiling installations 100*b*, 100*c* incorporated into grid frame elements 125*b*, 125*c* of tile ceilings 110*b* as drop-in installments.

More specifically, an installer can incorporate one or more ceiling installations 100*b*, 100*c*, and 700*a* into a tile ceiling as drop-in installments by securing the installations 100*b*, 100*c*, 700*a* between one or more grid frame elements 125*b*, 125*c*. To do so, the manufacturer can align one or more installment notches 415 of the ceiling installations 100*b*, 100*c*, 700*a* with the grid frame elements 125*b*, 125*c*. The installer can then slideably connect the grid frame elements 125*b*, 125*c* with the installment notches 415 of the ceiling installations 100*b*, 100*c*, 700*a*. In this way, the manufacturer can slideably insert the grid frame elements 125*b*, 125*c* into one or more installment notches 415 so that the ceiling installments 100*b*, 100*c*, 700*a* are slideably connected to the grid frame elements 125*b*, 125*c* as drop-in installments.

Further, FIG. 7B shows an exemplary cloud installment of a collapsible acoustic honeycomb ceiling installation 700*b*. More specifically, the cloud installment involves suspending a framed collapsible ceiling installation 700*b* from a ceiling 705*b*. For example, the ceiling installation 700*b* illustrated in FIG. 7B includes an outer frame 720 that surrounds the outer edges of the ceiling installation 700*b*. In one or more implementations, the frame 720 can surround all or part of the ceiling installation 700*b*. Also, in one or more implementations, the ceiling installation 700*b* may comprise more than one frame 720 or frame portions disposed between various inner sections of the ceiling installation 700*b*. The installer can use any means to suspend the collapsible ceiling installation 700*b* from the ceiling 705*b*.

To form a cloud installment, such as the cloud installment illustrated in FIG. 7B, a manufacturer or installer can suspend the ceiling installation 700*b* so as to hide the suspension means from view. In this way, at least in one implementation, a cloud installment appears to be hovering above the floor like a cloud.

For example, in the illustrated implementation of FIG. 7B, an installer can suspend the shown in FIG. 7B installation 700*b* using one or more cables 710 connected to the ceiling installation 700*b* at one end and the ceiling 705*b* at the other end. In such an implementation, the installer can connect one or more cables 710 to the frame 720, the ceiling installation 700*b* disposed within the frame 720, or both. Also, for example, the installer can secure the ceiling installation 700*b* to one or more side walls 715 of a room without the use of cables 710 connected above the ceiling installation 700*b*.

In addition, ceiling installations of the present disclosure are not limited to the size or shape of the collapsible ceiling installation 700*b* shown in FIG. 7B. Further, although FIG. 7B shows the cloud installment using a collapsible acoustic honeycomb ceiling installation 700*b* with a straight pattern configuration made of thermoplastic, the present disclosure is not so limited. The installer may use any pattern configuration or material in the cloud installment shown in FIG. 7B, as described herein.

Similarly, FIG. 7C shows an exemplary floating installment of a collapsible acoustic honeycomb ceiling installation 700*c*. Like the cloud installment of FIG. 7B, the floating installment suspends the collapsible ceiling installation 700*c* from the ceiling 705*c*. However, the floating installment employs a system of suspending the collapsible ceiling installation 700*c* that makes the collapsible ceiling installation 700*c* appear to be floating. For example, in one implementation, the system of suspending the ceiling installation 700*c* comprises one or more cables 710 connected to both the ceiling 705*c* and the ceiling installation 700*c*.

The circular collapsible ceiling installation 700*c* is an example of an alternative pattern configuration that falls within the scope of the present disclosure. One skilled in the art will appreciate that the collapsible ceiling installation

700*c* shown in FIG. 7C may be made from any material and have any pattern configuration. For example, in one or more implementations, the installations of the present disclosure may be triangular, rectangular, or otherwise polygonal or irregularly in shape.

Figure 8:
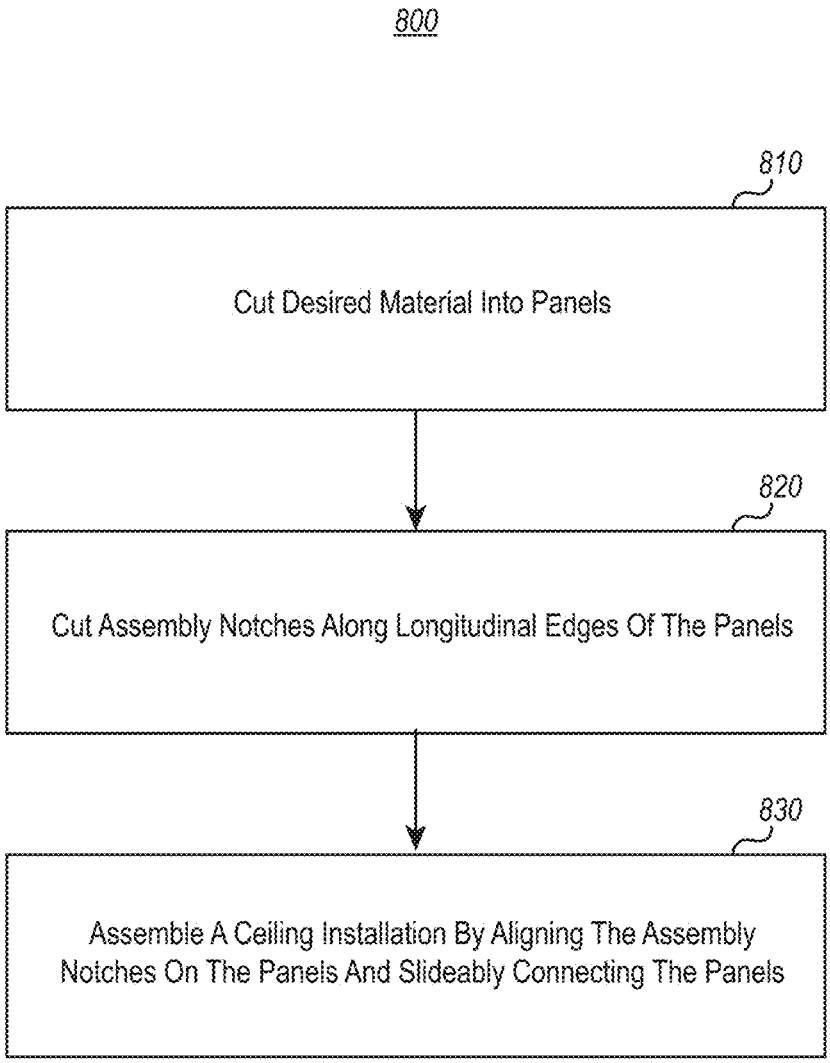
FIG. 8 illustrates a flowchart comprising steps in an exemplary method for producing a collapsible acoustic honeycomb ceiling installation.

FIG. 8 illustrates a flowchart comprising steps in an exemplary method for producing a collapsible acoustic honeycomb ceiling installation 800. As illustrated in FIG. 8, in at least one implementation of the present invention, the manufacturer may perform a step 810 of cutting desired material into panels. In addition, the manufacturer can perform step 820 of cutting notches along edges of the panels. Finally, FIG. 8 shows that the assembler can perform step 830 of assembling a ceiling installation by aligning the notches on the panels and slideably connecting the panels. For example, the assembler can assemble a ceiling installation with an angled pattern configuration or a straight pattern configuration.

One will appreciate that the method of manufacturing panels and assembling them into a collapsible ceiling installation may comprise one or more other steps. For example, in one implementation, the method 800 includes forming one or more angled grooves in one or more of the panels. In such an implementation, another step may include bending the panels at the angled grooves prior to assembling the panels together into a ceiling installation.

Also, in one or more implementations of the present disclosure, a method for forming a collapsible ceiling installation may include cutting one or more installment notches into one or more transverse edges of each panel. In one or more implementations, the method 800 may also include cutting one or more installment notches on a longitudinal edge of a panel having an angled groove formed therein. In such an implementation, the manufacturer may form an installment notch along a longitudinal edge of the panel corresponding in position with each angled groove.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A ceiling system comprising:

a plurality of panels, each panel comprising:

a length of at least about 16-inches;

a height of at least about 1-inch;

a thickness equal to or less than about ⅛-inch;

a plurality of assembly notches having respective widths equal to or greater than the thickness of each of the plurality of panels; and a plurality of installment notches each disposed at an outer edge of the ceiling system;

wherein:

each of the plurality of panels is slideably connectable to at least one other panel through respective assembly notches to form the ceiling system such that when two panels are connected to each other, the two connected panels are rotatable about an assembly notch, relative to one another, wherein at least one of the plurality of installment notches of each panel of the plurality of panels comprises at least one installment notch cut into a transverse edge of the panel; and the rotatable connection of the panels enables collapsibility of the ceiling system.

2. The ceiling system of claim 1, wherein one or more of the plurality of panels comprises a textile material.

3. The ceiling system of claim 1, wherein one or more of the plurality of panels comprises a thermoplastic material.

4. The ceiling system of claim 1, wherein one or more of the plurality of panels comprises a composite material of a textile and a thermoplastic.

5. The ceiling system of claim 1, wherein:

at least one panel of the plurality of panels further comprises an angled groove; and one of the installment notches of the at least one panel having an angled groove comprises a t-shaped installment notch cut into a longitudinal edge of the panel corresponding in position with the angled groove.

6. The ceiling system of claim 1, wherein two panels of the plurality of panels that are slideably connectable are angled perpendicular, relative to one another.

7. The ceiling system of claim 1, wherein two panels of the plurality of panels that are slideably connectable are angled non-perpendicular, relative to one another.

8. The ceiling system of claim 1, wherein each of the plurality of panels is slideably connected to at least one other panel through respective assembly notches to form the ceiling system and the ceiling system is collapsed.

9. The ceiling system of claim 1, wherein each of the plurality of panels is not slideably connected to at least one other panel when the ceiling system is disassembled.

10. A ceiling system comprising:

a plurality of panels, each panel comprising:

a length of at least about 16-inches;

a height of at least about 1-inch;

a thickness equal to or less than about ⅛-inch;

a plurality of assembly notches having respective widths equal to or greater than the thickness of each of the plurality of panels; and a plurality of installment notches each disposed at an outer edge of the ceiling system;

wherein:

each of the plurality of panels is slideably connectable to at least one other panel through respective assembly notches to form the ceiling system such that when two panels are connected to each other, the two connected panels are rotatable about an assembly notch, relative to one another;

the rotatable connection of the panels enables collapsibility of the ceiling system;

at least one panel of the plurality of panels has an angled groove; and one of the installment notches of the at least one panel having an angled groove comprises a t-shaped installment notch cut into a longitudinal edge of the panel corresponding in position with the angled groove.

11. The ceiling system of claim 10, wherein one or more of the plurality of panels comprises a textile material.

12. The ceiling system of claim 10, wherein one or more of the plurality of panels comprises a thermoplastic material.

13. The ceiling system of claim 10, wherein one or more of the plurality of panels comprises a composite material of a textile and a thermoplastic.

14. The ceiling system of claim 10, wherein at least one of the plurality of installment notches of each panel of the plurality of panels comprises at least one installment notch cut into a transverse edge of the panel.

15. The ceiling system of claim 10, wherein two panels of the plurality of panels that are slideably connectable are angled perpendicular, relative to one another.

16. The ceiling system of claim 10, wherein two panels of the plurality of panels that are slideably connectable are angled non-perpendicular, relative to one another.

17. The ceiling system of claim 10, wherein each of the plurality of panels is slideably connected to at least one other panel through respective assembly notches to form the ceiling system and the ceiling system is collapsed.

18. The ceiling system of claim 10, wherein each of the plurality of panels is not slideably connected to at least one other panel when the ceiling system is disassembled.

* * * * *